US005338655A

United States Patent [19]

Kubotera et al.

[11] Patent Number: 5,338,655

[45] Date of Patent: Aug. 16, 1994

[54] METHOD FOR MANUFACTURING A SILVER HALIDE EMULSION

[75] Inventors: Mitsuhiro Kubotera; Makoto Kajiwara, both of Odawara, Japan

[73] Assignee: Konica Corporation, Tokyo, Japan

[21] Appl. No.: 939,055

[22] Filed: Sep. 2, 1992

[30] Foreign Application Priority Data

Sep. 19, 1991 [JP] Japan ..... 3-268488

[51] Int. Cl.[5] ..... G03C 1/015; G03C 1/025; G03C 1/09; G03C 1/14

[52] U.S. Cl. ..... 430/569; 430/583; 430/584; 430/585; 430/605

[58] Field of Search ..... 430/567, 569, 583, 584, 430/585, 605

[56] References Cited

U.S. PATENT DOCUMENTS 4,828,972 5/1989 Ihama et al. ..... 430/569

5,015,563 5/1991 Ohya et al. ..... 430/569

FOREIGN PATENT DOCUMENTS 256781 2/1988 European Pat. Off. .

278510 8/1988 European Pat. Off. .

291339 11/1988 European Pat. Off. .

*Primary Examiner*—Charles L. Bowers, Jr.

*Assistant Examiner*—Mark F. Huff

*Attorney, Agent, or Firm*—Jordan B. Bierman

[57] ABSTRACT

A method of manufacturing a silver halide emulsion wherein spectral sensitizing dyes are added after the formation of silver halide grains, and chemically ripening is then carried out at a temperature higher than the addition temperature of the spectral sensitizing dyes at 25° C. to 55° C., is disclosed. A material produced by this method has a high linearity in gradation between the medium density part and the shoulder part, and having a high Dmax value.

15 Claims, 1 Drawing Sheet

METHOD FOR MANUFACTURING A SILVER HALIDE EMULSION

FIELD OF THE INVENTION

The present invention relates to a method for manufacturing a silver halide photographic emulsion which can provide an emulsion having an excellent gradation less in fluctuations among lots, a capability of producing high densities and excellent exposure properties.

BACKGROUND OF THE INVENTION

With the advance of the rapid processing technique in recent years, rapid processing of a large amount of color photographic materials for prints has been achieved. And it has been strongly demanded that a light-sensitive material have a much stabler performance varying less within a lot or among lots in manufacturing as well as a capability of producing high quality images. Gradation reproduction is an important factor for obtaining light-sensitive material producing high quality images. The gradation can be divided into a foot part gradation ranging from low density part to medium density part, a linear part gradation ranging from medium density part to high density part, and a shoulder part gradation up to the highest density part, each of which is essential to gradation reproduction. Particularly, the linear part gradation is fundamental for gradation reproduction; therefore, a poor linearity may cause a fatal defect in gradation reproduction. Further, a light-sensitive material having a wide exposure latitude is demanded for the purpose of improving description of details In order to reconcile a proper gradation reproduction and a wide exposure latitude, a much higher maximum density (hereinafter referred to as Dmax) is required. Accordingly, there is a demand for a lightsensitive material which has a linear part gradation excellent in linearity and is capable of providing a high Dmax value. Though various approaches have been made to satisfy the requirement, there is much room left for improvement even now. For example, Japanese Pat. O.P.I. Pub. Nos. 225141/1985 and 225142/1985 propose to mix two different kinds of emulsions for improvement in gradation. This method, though effective in enhancing the linearity of a gradation, cannot provide an adequately high Dmax value; therefore, improvement of the linearity and enhancement of Dmax cannot be reconciled with each other by this method alone. Further, this method is not for stabilizing the manufacture of an emulsion.

Various efforts have been made in the art to improve the sensitivity of emulsions by use of spectral sensitizing dyes. For example, in Japanese Pat. O.P.I. Pub. No. 9653/1984, the emulsion stability is improved by adding spectral sensitizing dyes after the completion of chemical ripening; in Japanese Pat. O.P.I. Pub. No. 41849/1988, diminution in storage fog and prevention of soft gradation are attempted by adding spectral sensitizing dyes during the formation of silver halide grains. However, an emulsion chemically ripened directly after the formation of silver halide grains is different in gradation from an emulsion stored temporarily in a refrigerator after the formation of silver halide grains and then chemically ripened after few days; accordingly, these techniques cannot support the stable material supply in production, which the present invention aims at, and are not methods for raising a Dmax value. Though various improvements have been attempted as by the addition of spectral sensitizing dyes described above, it is not easy to control the use of spectral sensitizing dyes properly, and even small changes in addition time or addition temperature thereof often lead to large changes in performances thereof.

Japanese Pat. O.P.I. Pub. No. 125612/1983 discloses a technique to reduce fogs and improve the description of highlights by controlling the pAg and temperature during chemical ripening. However, this is a technique for improving the description of highlights by reducing the temperature, and not for obtaining a gradation high in linearity and Dmax value which the present invention aims at.

On the other hand, the speed-up of development has accelerated the spread of mini-laboratories engaged in rapid processing, and the processing pattern of light-sensitive materials has also come to change. There has so far been a demand for light-sensitive materials of which latent images are stable for 10 minutes to 24 hours or for the time interval between exposing and processing, and light-sensitive materials so-manufactured have been supplied. With the spread of mini-laboratories, however, stabilization of latent images in the very early stage, which covers several seconds to several minutes after exposing, has come to be the most important. Further, services of delivering finished prints on the spot to customers making trips to resorts, by utilizing the merit of mini-laboratories having a capability of rapid-processing have increased. This creates the necessity for light-sensitive materials less susceptible to temperature and humidity, because the control of temperature and humidity performed at ordinary processing laboratories cannot be carried out by mini-laboratories in resorts where temperature and humidity change with changes of the seasons.

SUMMARY OF THE INVENTION

An object of the present invention is to provide a method for manufacturing an emulsion having an improved linearity in gradation from medium density part to shoulder part and a high Dmax value. Another object of the invention is to provide a method for manufacturing a stable emulsion less in gradation fluctuation. A further object of the invention is to provide a silver halide photographic light-sensitive material excellent in latent image stability for several seconds to several minutes after exposing in the very early stage of the time interval between exposing and processing, and less susceptible in photographic properties to the temperature and humidity at the time of exposure.

The above problems are solved by the method of the invention for manufacturing a silver halide emulsion, in which spectral sensitizing dyes are added after the formation of silver halide grains at a temperature not lower than 25° C. and not higher than 55° C., and chemical ripening is performed at a temperature higher than the addition temperature of the spectral sensitizing dyes.

DESCRIPTION OF THE SIGNS

Figure 1:
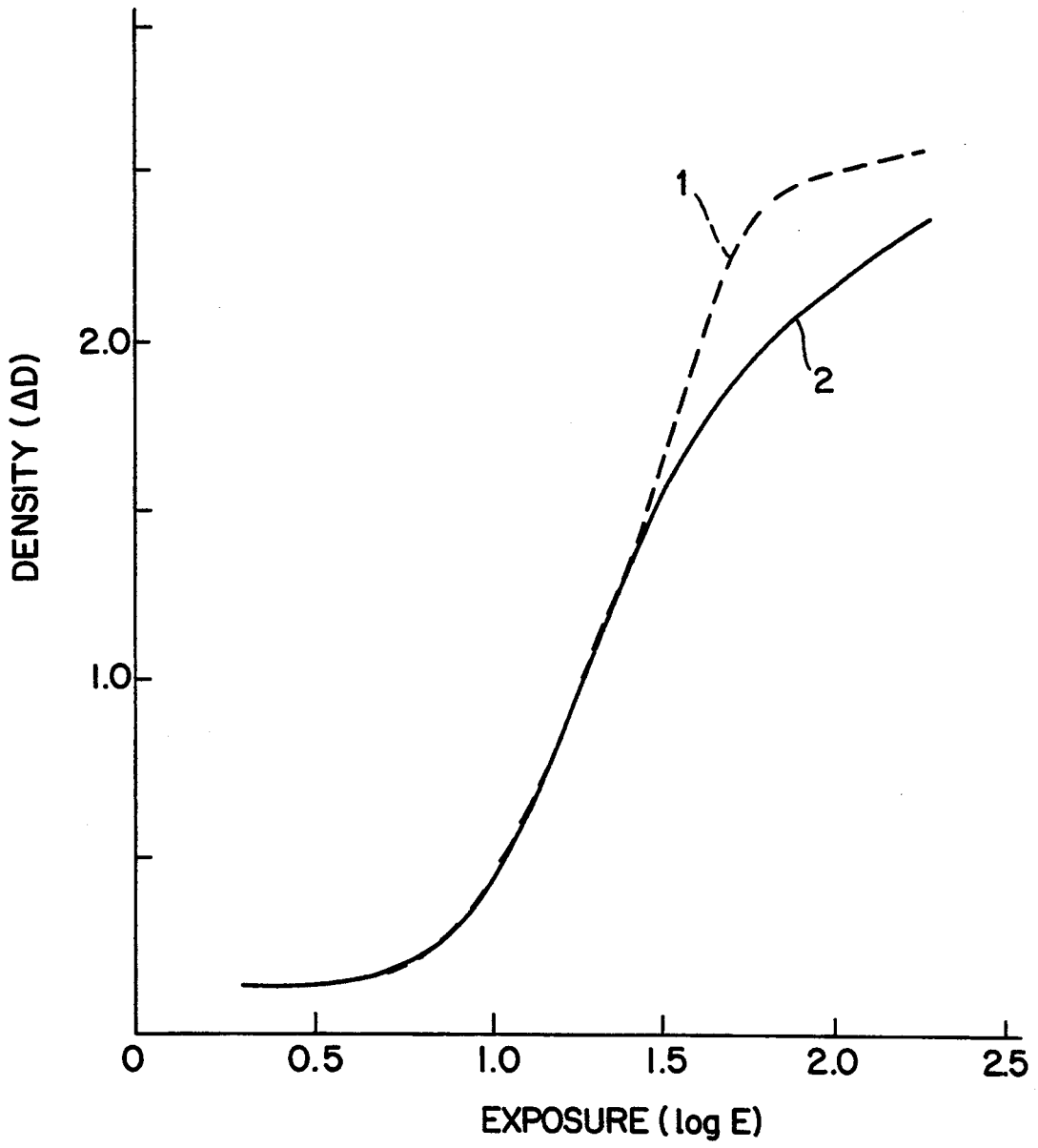
FIG. 1: a figure showing a sensitometry curve of a silver halide emulsion of the invention and that of a comparative emulsion.

1: a sensitometry curve of a silver halide emulsion of the invention

2: a sensitometry curve of a comparative emulsion

DETAILED DESCRIPTION OF THE INVENTION

In the invention, "spectral sensitizing dyes added after the formation of silver halide grains" are photographic spectral sensitizing dyes having a spectral sensitizing function. These spectral sensitizing dyes are added, after the formation of silver halide grains, at a temperature lower than the chemical ripening temperature (the chemical ripening temperature means a temperature at which chemical sensitizers are added). After the addition of spectral sensitizing dyes, a rise in the chemical ripening temperature not less than 0.1° C. improves the linearity of gradation, and this effect becomes more conspicuous with a temperature rise larger than 5° C. The addition temperature of spectral sensitizing dyes can be arbitrarily set within the range of 25° to 55° C., preferably 30° to 50° C. But it must be lower than the temperature of the chemical ripening. In the invent ion, the pAg of an emulsion at the time of adding spectral sensitizing dyes is 6.0 to 8.0, preferably 6.0 to 7.0 and especially 6.0 to 6.5. Setting the pAg within this range improves the resistance of a light-sensitive material to temperature and humidity at exposure and lessens fluctuations in sensitivity. Though the pAg of an emulsion may be arbitrarily set after the addition of spectral sensitizing dyes, rising the pAg after the addition of spectral sensitizing dyes has a favorable effect of controlling increase in fogs. In the invention, the amount of spectral sensitizing dyes added to an emulsion is preferably $1\times10^{-6}$ to $5\times10^{-3}$ mol per mol of silver. In the invention, any spectral sensitizing dye can be effectively used singly or in combination as long as it has a spectral sensitizing function. Preferred sensitizing dyes are those represented by the following Formula (A) :

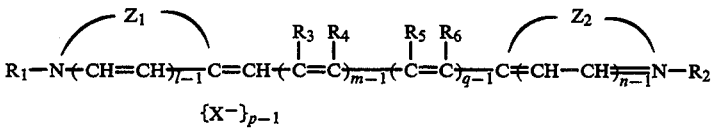

Formula A wherein $Z_1$ and $Z_2$, which may be the same or different, each represent a group of atoms necessary to form a heterocycle; $R_1$ and $R_2$ may be the same or different and individually represent an alkyl group, an aryl group, an alkenyl group or an aralkyl group; $R_3$ to $R_6$ each represent a hydrogen atom, an alkyl group having 4 or less carbon atoms, an aryl group, an aralkyl group, or a heterocyclic group; $R_2$ and $R_6$ (when q=2) or $R_3$ and $R_5$ (when m=2, q=2) may be linked in the form of alkylene bridge to form a five- or six-membered ring; l, m, n, q and p each represent 1 or 2.

$X^-$ represents an anion.

Formula (A) is hereunder described in more detail. Wherein $Z_1$ and $Z_2$, which may be the same or different and are individually a group of atoms necessary to form a heterocycle, each represent a group of atoms necessary to form an oxazoline nucleus, an oxazole nucleus, a benzoxazole nucleus, a naphthoxazole nucleus (e.g. nephtho[2, 1-d]oxazole, naphtho[1,2-d]oxazole, naphtho[2,3-d]oxazole), a thiazoline nucleus, a thiazole nucleus, a benzothiazole nucleus, a naphthothiazole nucleus (e.g. naphtho[1,2-d]thiazole, naphtho[2,1-d]thiazole, naphtho[2,3-d]thiazole), a selenazoline nucleus, a selenazole nucleus, a benzoselenazole nucleus a naphthoselenazole nucleus (e.g. naphtho [1,2-d]selenazole, naphtho [2, 1-d]selenazole, naphtho [2,3-d]selenazole), a tellurazole nucleus, a benzotellurazole nucleus, a naphthotellurazole nucleus (e.g. naphtho [2,1d]tellurazole), naphtho [1,2-d]tellurazole, an imidazole nucleus, a benzimidazole nucleus, a naphthimidazole nucleus (e.g. naphtho [1,2-d]imidazole, naphtho [2,3-d]imidazole), a pyridine nucleus, a pyrrolidine nucleus, a tetrazole nucleus or a quinoline nucleus. Among these nuclei, a benzothiazole nucleus, a benzimidazole nucleus and a benzoxazole nucleus are preferred, and a benzothiazole nucleus is particularly preferred.

These nuclei may have one or more substituents on the respective rings.

Preferred examples of such substituents include a hydroxyl group, a halogen atom (e.g. fluorine, chlorine, bromine), an unsubstituted or substituted alkyl group (e.g. methyl, ethyl, propyl, isopropyl, hydroxyethyl, carboxymethyl, ethoxycarbonylmethyl, trifluoromethyl, chloroethyl, methoxymethyl), an aryl or substituted aryl group (e.g. phenyl, tolyl, anisyl, chlorophenyl, 1-naphthyl, 2-naphthyl, carboxyphenyl), a heterocyclic group (e.g. 2-thienyl, 2-furyl, 2-pyridyl), an aralkyl group (e.g. benzylphenethyl, 2-furylmethyl) an alkoxy group (e.g. methoxy, ethoxy, butoxy), an alkylthio group (e.g. methylthio, ethylthio), a carboxyl group, an alkoxycarbonyl group (e.g. methoxycarbonyl, ethoxycarbonyl, butoxycarbonyl), an acylamino group (e.g. acetylamino, propionylamino, benzoylamino), a methylenedioxy group, a tetramethylene group, a cyano group, a carbamoyl group (e.g. dimethylcarbamoyl, methylcarbamoyl, phenylcarbamoyl), an acyl group (e.g. acetyl, propionyl, benzoyl), an alkylsulfonyl group (e.g. methylsulfonyl, ethylsulfonyl), an alkylsulfinyl group (e.g. methylsulfinyl, ethylsulfinyl), an arylsulfonyl group (e.g. phenylsulfonyl, p-tolylsulfonyl) and a sulfamoyl group (e.g. methylsulfamoyl, ethylsulfamoyl ).

$R_1$ and $R_2$ each represent an alkyl group, an aryl group, an alkenyl group, an aralkyl group, each of which may be unsubstituted or substituted. The preferred group is an alkyl group having a sulfo group as a substituent. Examples thereof include methyl, ethyl, propyl, butyl, isopropyl, pentyl, hexyl, 2-hydroxyethyl, 3-hydroxypropyl, 2- (2-hydroxyethoxy) ethyl, 2-ethoxycarbonylmethyl, 2-sulfoethyl, 3-sulfopropyl, 3-sulfobutyl, 4-sulfobutyl, 2-hydroxy-3-sulfopropyl, 2-chloro-3-sulfopropyl, 2- (3-sulfopropyloxy)ethyl, 2-sulfatethyl, 3-sulfatpropyl, 3-thiosulfatpropyl, 2-phosphonoethyl, 2-chloroethyl, 2,2,2-trifluoroethyl, 2,2,3,3-tetrafluoropropyl, 2-carbamoylethyl, 3-carbamoylpropyl, methoxyethyl, ethoxyethyl, methoxypropyl, allyl, phenyl, tolyl, carboxyphenyl, sulfophenyl, naphthyl, sulfonaphthyl, benzyl, phenethyl, p-sulfophenethyl, m-sulfophenethyl and p-carboxyphenethyl.

$R_3$, $R_4$, $R_5$ and $R_6$ each represent a hydrogen atom, an alkyl group having 4 or less carbon atoms, an aralkyl group, an aryl group or a heterocyclic group.

Examples of the alkyl group include methyl, ethyl, propyl and butyl; examples of the aralkyl group include benzyl, and phenethyl; examples of the aryl group include phenyl and p-tolyl.

Examples of the heterocyclic group include aromatic heterocyclic groups such as thienyl and furyl and acid heterocyclic groups represented by the following Formula (B):

Formula (B)

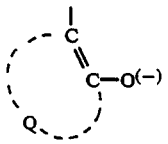

In Formula (B), Q represents a group of nonmetallic atoms necessary to form a five- or six-membered heterocyclic nucleus selected from, for example, pyrazolone derivatives, isooxazolone derivatives, oxazolone derivatives, 2,4,6-triketohexahydropyrimidine derivatives, 2-thio-2,4, 6-triketohexahydropyrimidine, rhodanine derivatives, 2,4-thiazolidinedione derivatives, 2-thio-2, 4-oxazolidinedione derivatives, thianaphthenone derivatives, hydantoin derivatives, indanedione derivatives and oxyindole derivatives.

$R_2$ and $R_6$ (when q=2) or $R_3$ and $R_5$ (when m=2, q=2) may be linked in the form of alkylene bridge to form a five- or six-membered ring. Among the substituents of $R_3$ or R6, the preferred ones are a hydrogen atom and an alkyl group. l, m, n, q and p each represent 1 or 2, preferably q represents 1, particularly preferably m and q each represent 1.

Spectral sensitizing dyes favorably used in the invention are exemplified below. However, it is natural that usable compounds are not limited to these exemplifications.

I-1

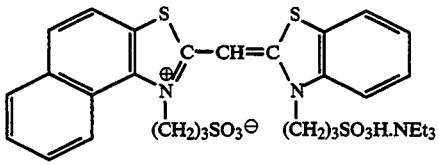

I-2

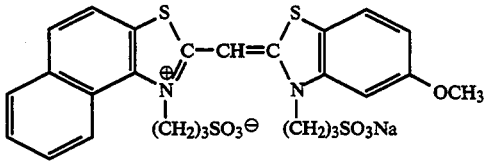

I-3

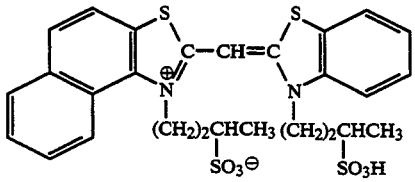

I-4

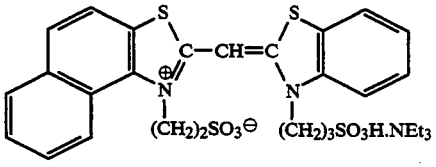

I-5

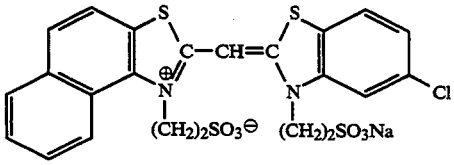

I-6

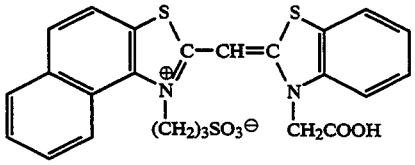

I-7

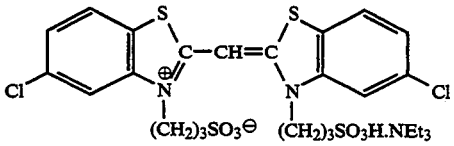

-continued
I-8
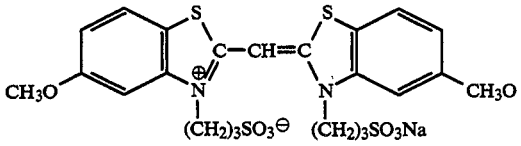
I-9
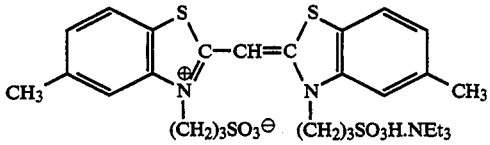
I-10
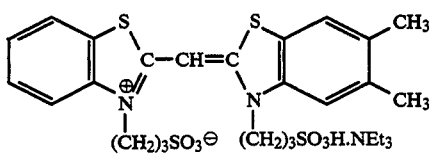
I-11
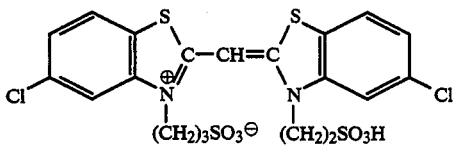
I-12
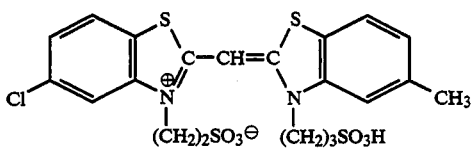
I-13
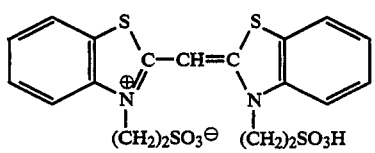
I-14
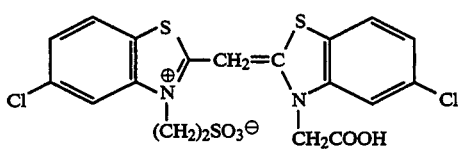
I-15
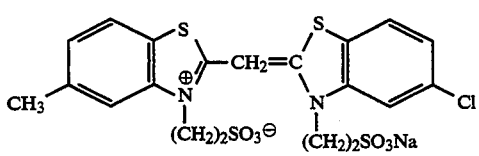
I-16
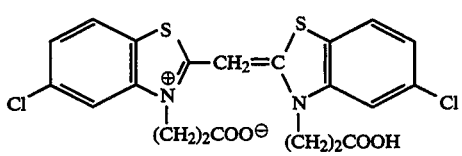
I-17
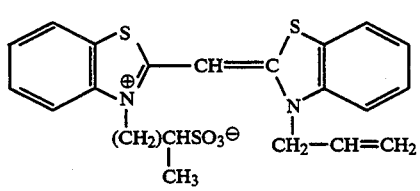

-continued
I-18
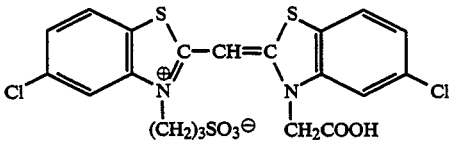
I-19
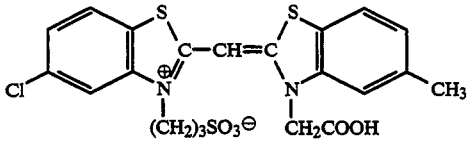
I-20
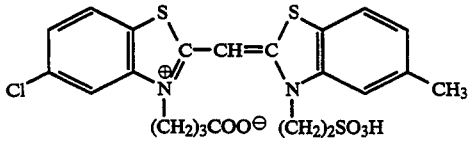
I-21
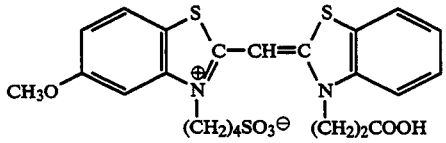
I-22
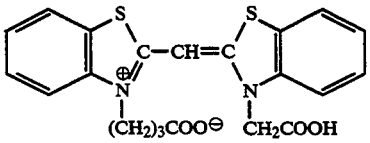
I-23
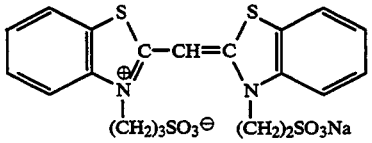
I-24
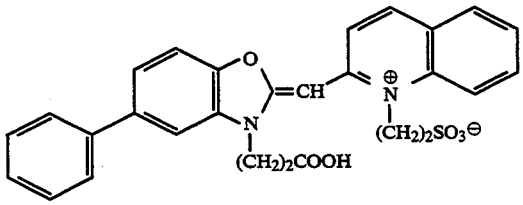
I-25
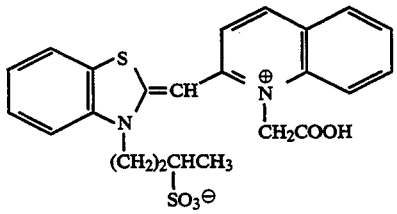
I-26
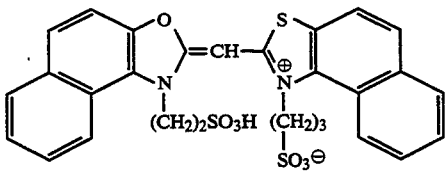

-continued
I-27
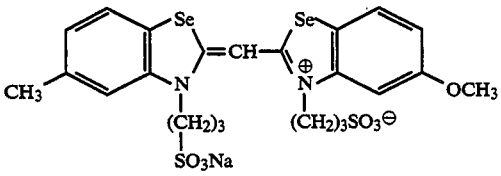
I-28
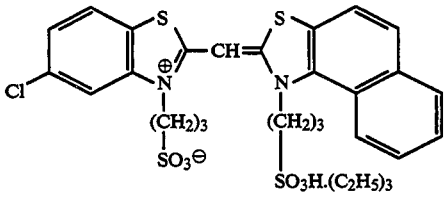
I-29
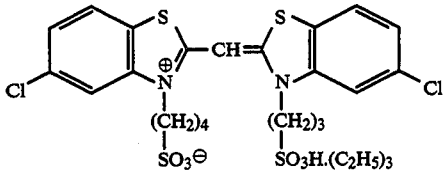
I-30
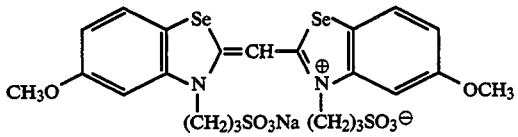
I-31
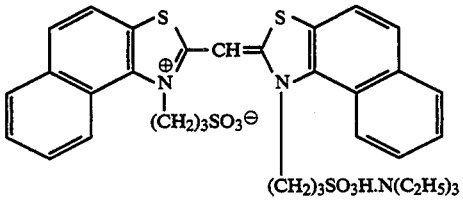
(II-1)
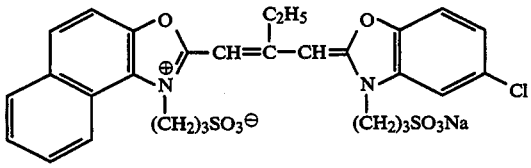
(II-2)
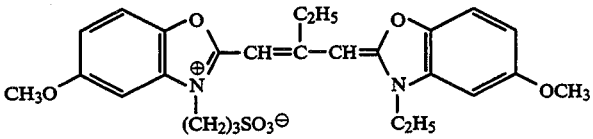
(II-3)
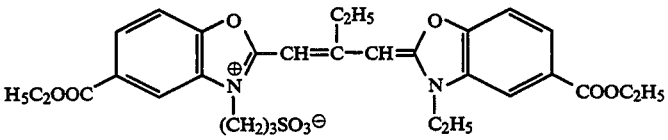
(II-4)
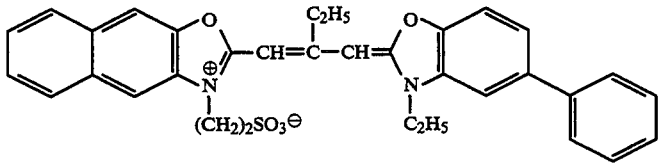

-continued
(II-5)
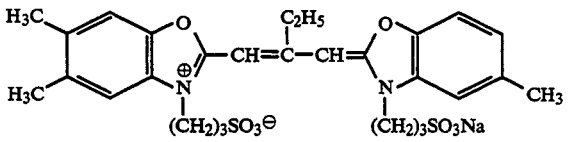
(II-6)
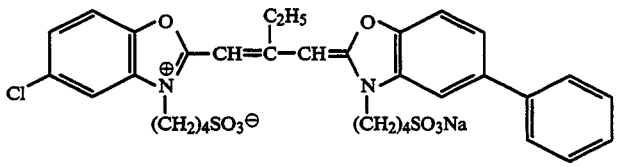
(II-7)
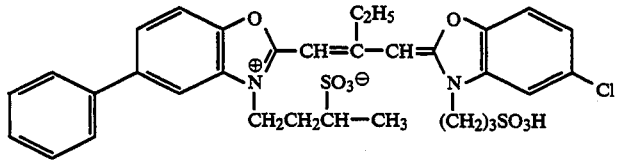
(II-8)
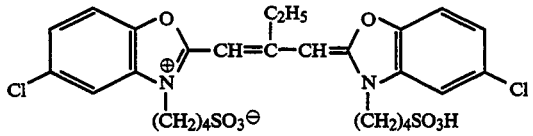
(II-9)
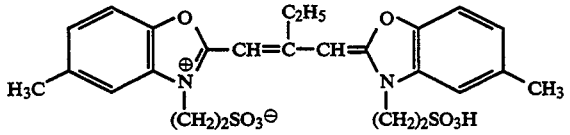
(II-10)
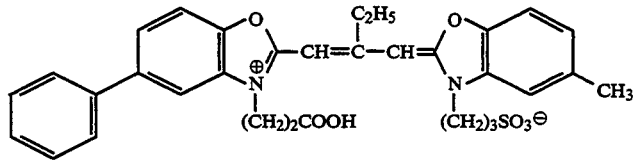
(II-11)
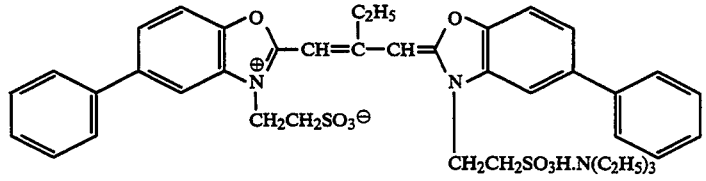
(II-12)
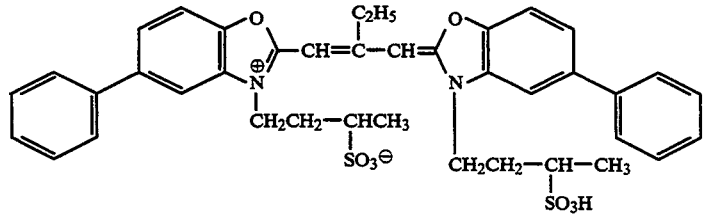
(II-13)
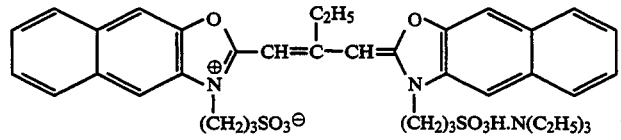

-continued
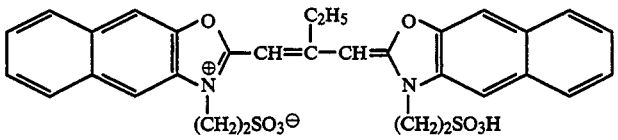
(II-14)
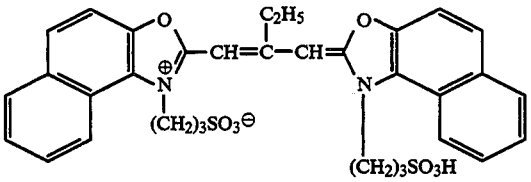
(II-15)
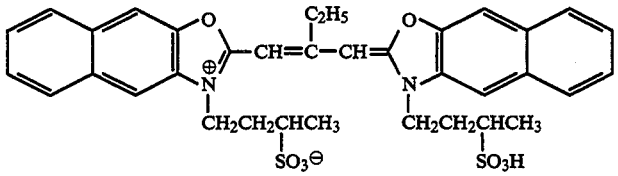
(II-16)
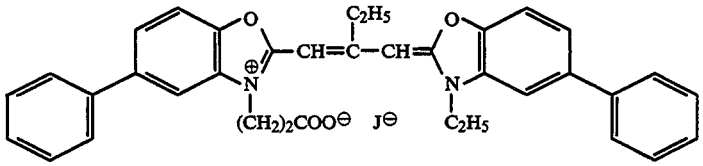
(II-17)
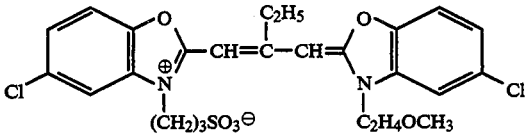
(II-18)
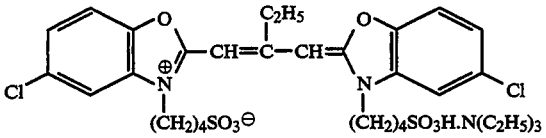
(II-19)
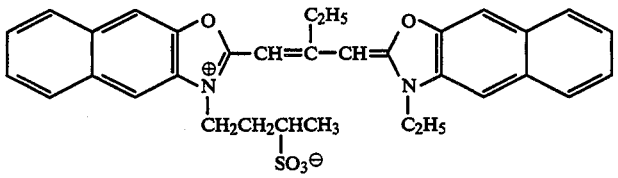
(II-20)
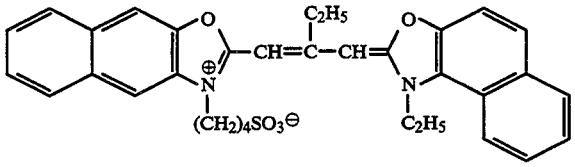
(II-21)
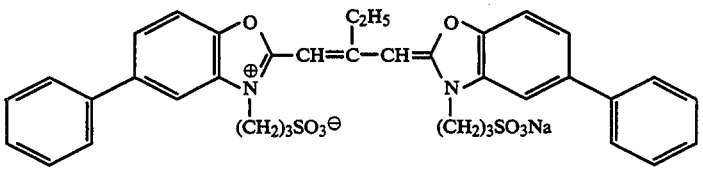
(II-22)

-continued
(II-23)
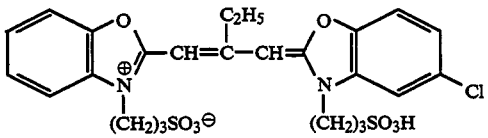
(II-24)
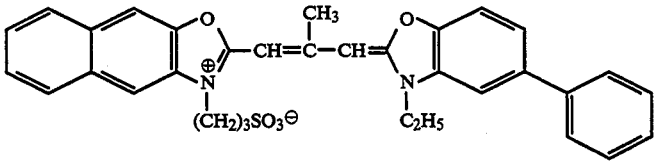
(II-25)
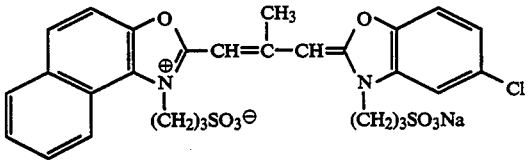
(II-26)
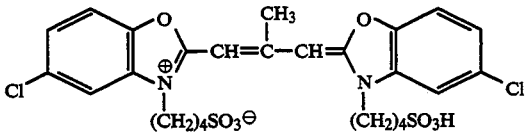
(II-27)
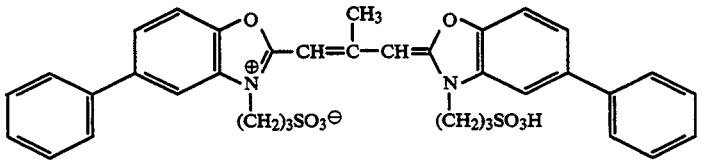
(II-28)
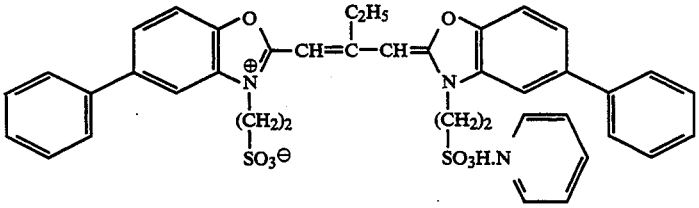
(II-29)
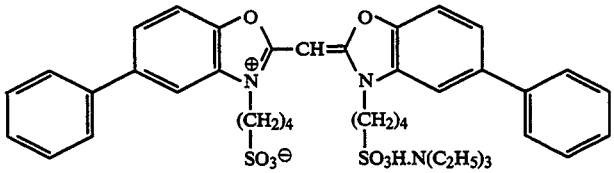
(II-30)
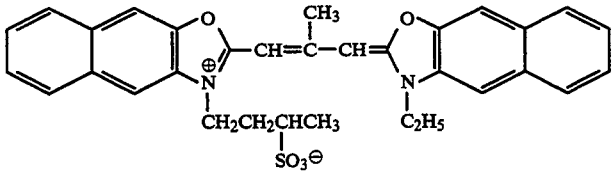
(II-31)
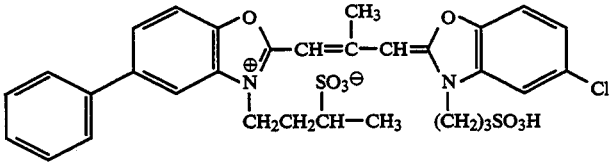

-continued
(II-32)
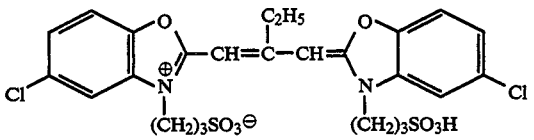
(II-33)
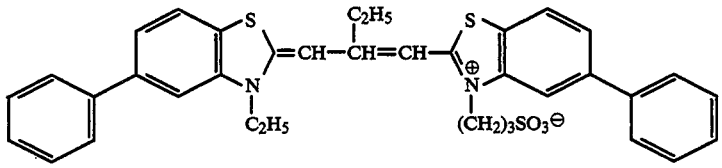
(II-34)
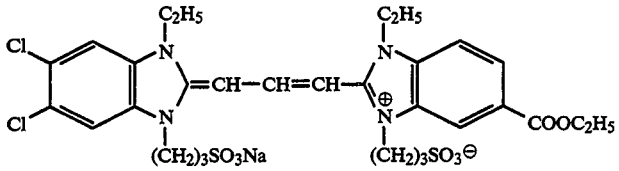
(II-35)
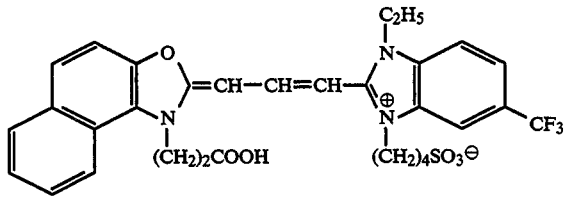
(III-1)
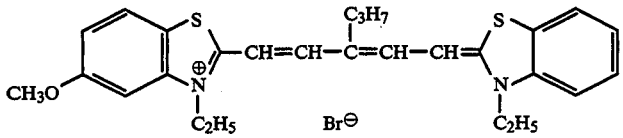
(III-2)
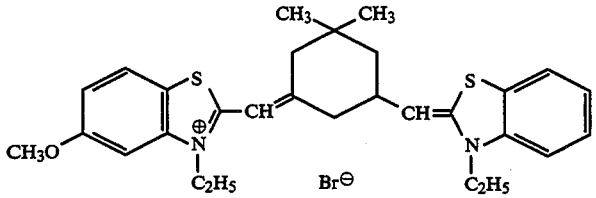
(III-3)
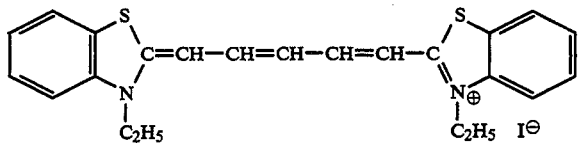
(III-4)
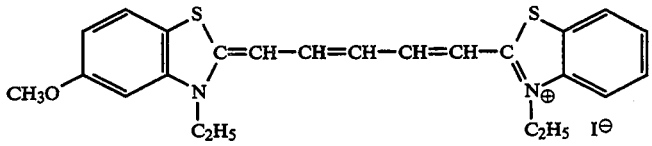
(III-5)
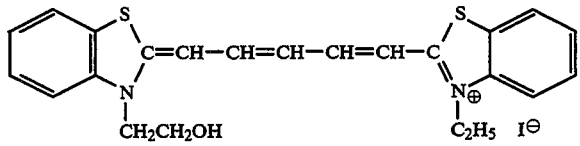

-continued
(III-6)
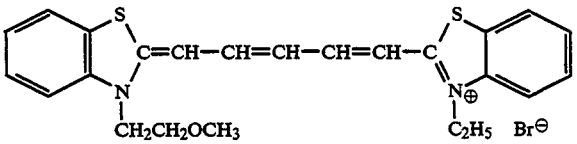
(III-7)
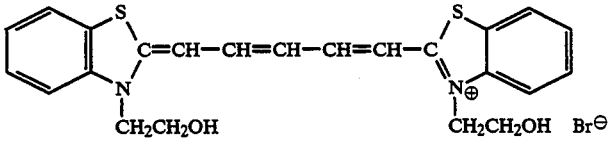
(III-8)
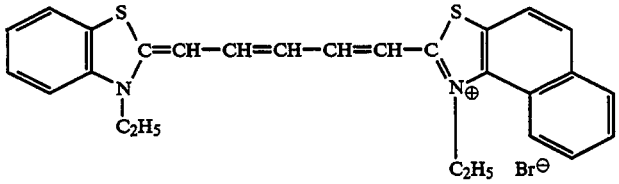
(III-9)
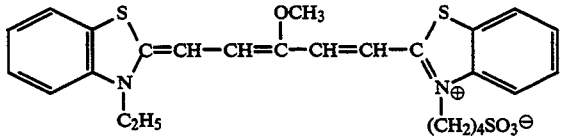
(III-10)
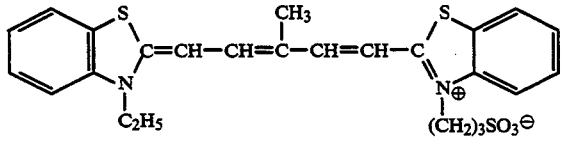
(III-11)
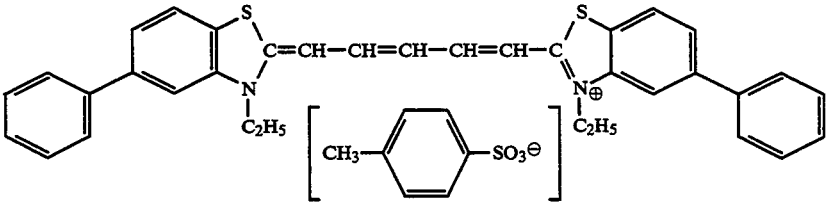
(III-12)
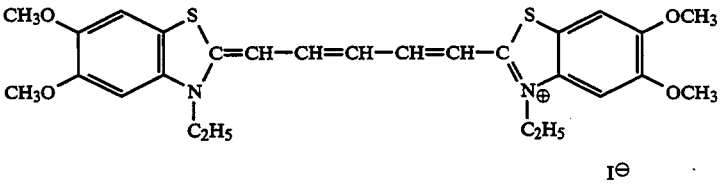
(III-13)
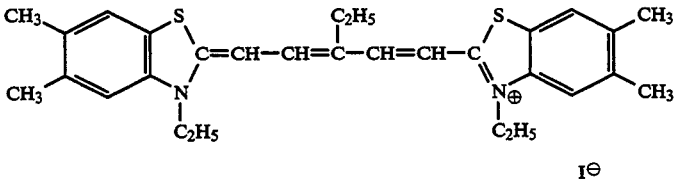
(III-14)
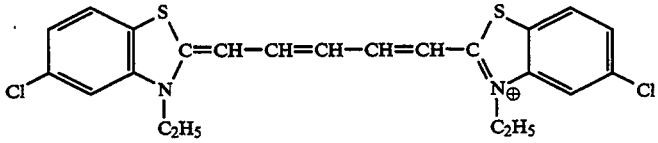

-continued
(III-15)
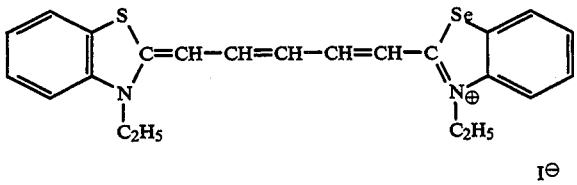
(III-16)
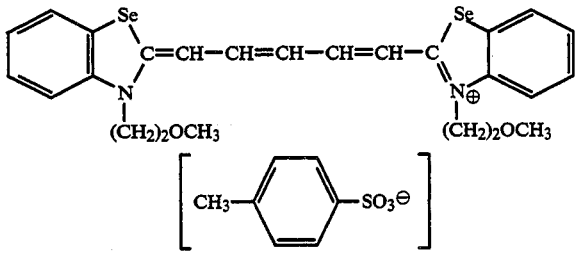
(III-17)
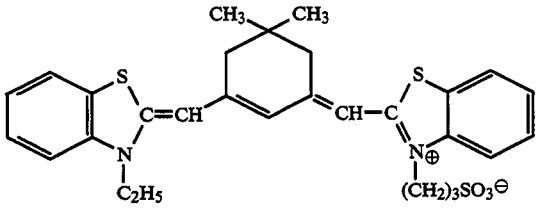
(III-18)
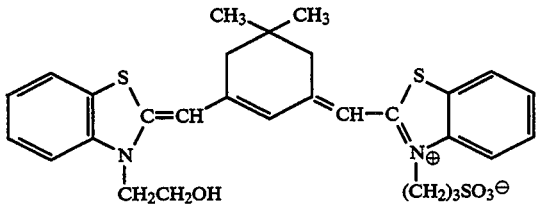
(III-19)
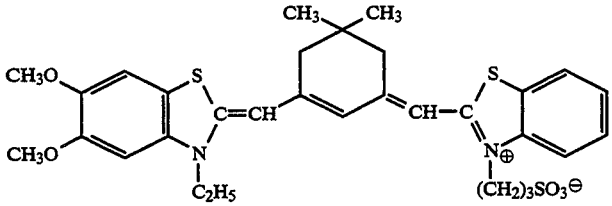
(III-20)
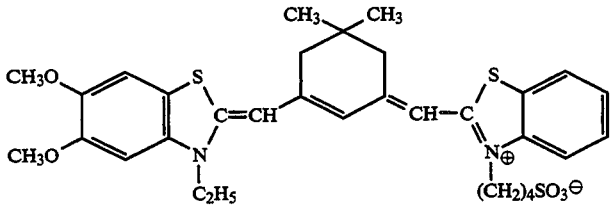
(III-21)
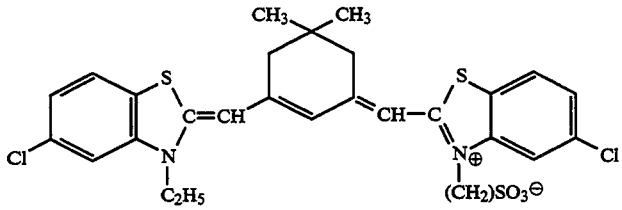

-continued
(III-22)
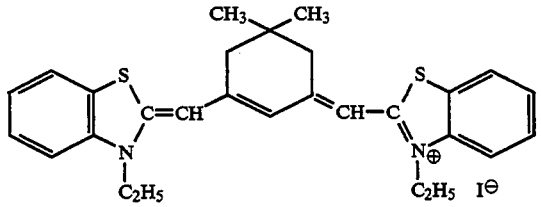
(III-23)
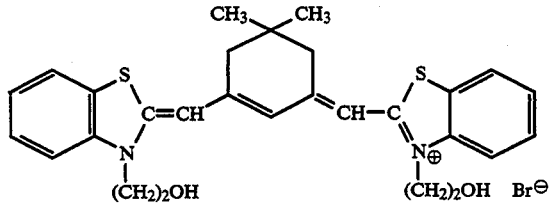
(III-24)
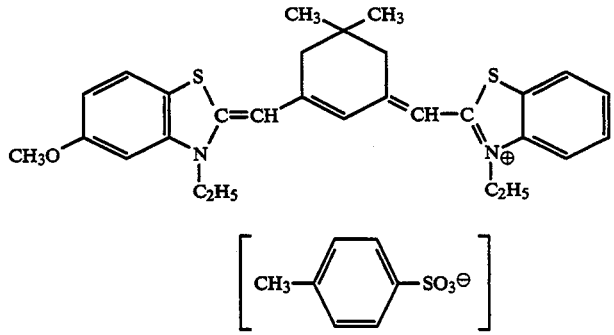
(III-25)
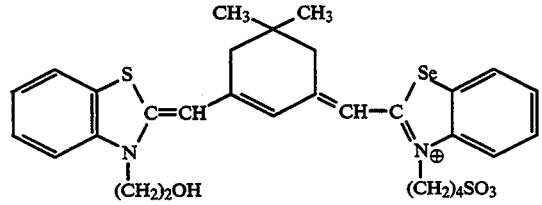
(III-26)
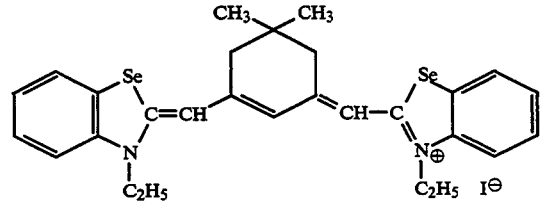
(III-27)
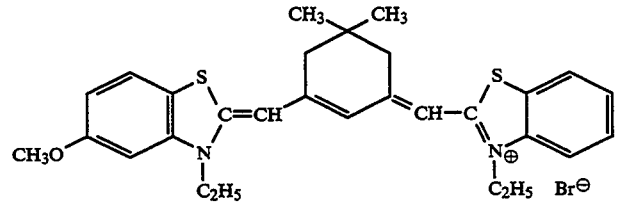
(III-28)
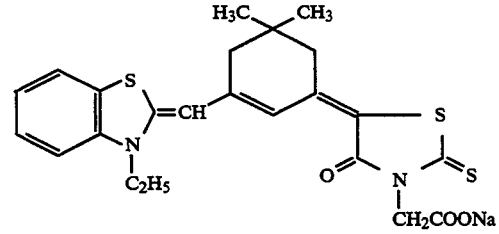

-continued
(III-29)
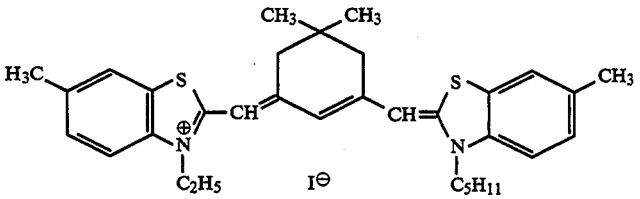
(III-30)
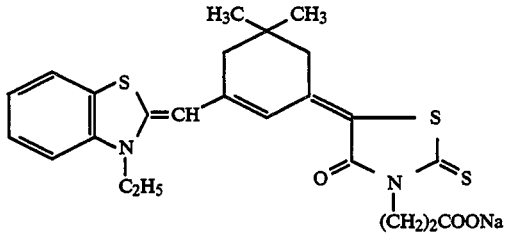
(III-31)
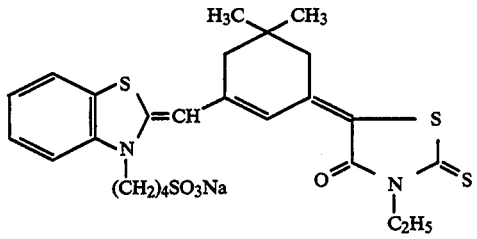
(III-32)
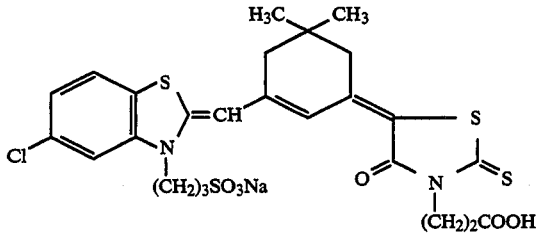
(III-33)
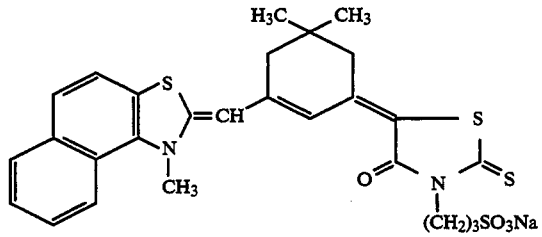
(III-34)
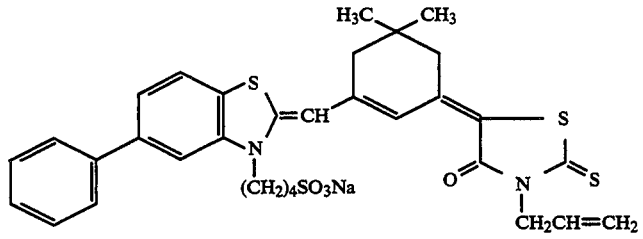
(III-35)
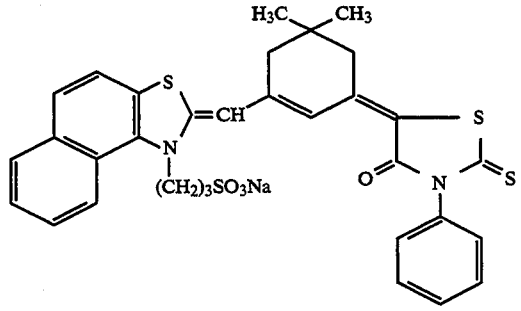

-continued
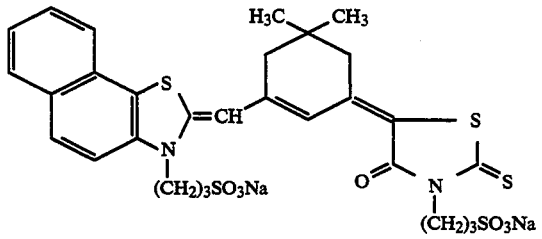
(III-36)
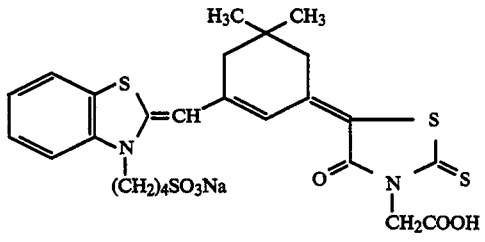
(III-37)
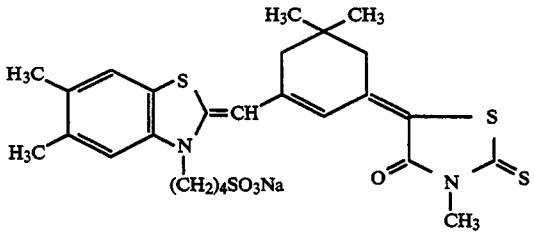
(III-38)
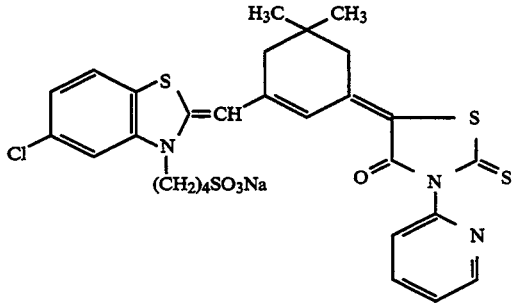
(III-39)
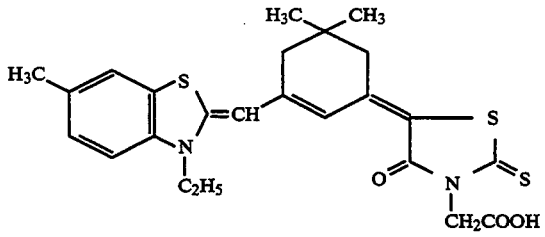
(III-40)
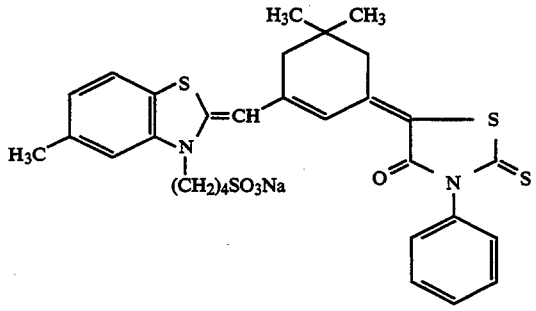
(III-41)

-continued (III-42)

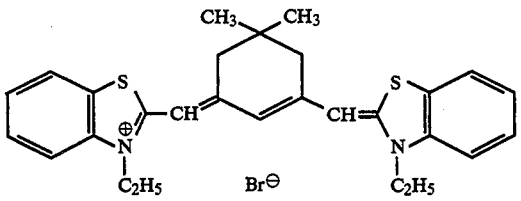

(III-43)

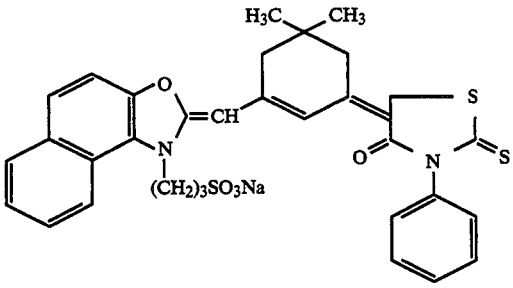

(III-44)

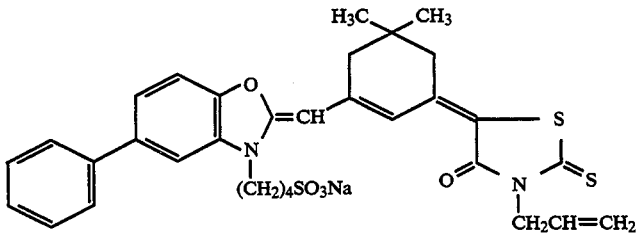

(III-45)

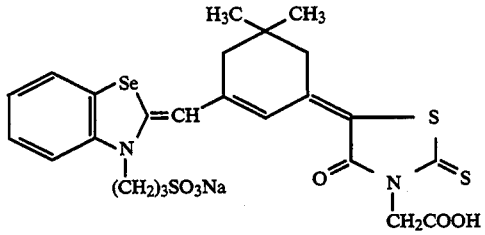

The silver halide grains used in the invention may be formed by any method such as the acid method, the neutral method and the ammoniacal method.

Further, these silver halide grains may be formed, for example, by a two step method; that is, seed grains are firstly prepared by the acid method and then they are grown to a prescribed size by the ammoniacal method which can provide a faster growth speed. Of course, seed grains prepared by the acid method may be grown by the acid method or by the neutral method. During the growth of silver halide grains, it is preferable that the pH and pAg of the reaction liquor be properly controlled, and that silver ions and halide ions be sequentially and simultaneously added in amounts corresponding to the growth rate of silver halide grains as described in Japanese Pat. O.P.I. Pub. No. 48521/1979.

After the formation of silver halide grains, soluble salts contained therein are usually removed (desalting).

Desalting can be conducted by any of the conventional methods, such as the noodle-washing method which is performed by allowing gelatin to gel and the flocculation method which employs inorganic salts comprised of polyvalent anions or gelatin derivatives (e.g., aliphatic acylated gelatin, aromatic acylated gelatin or aromatic carbamoylated gelatin).

After the desalting, the silver halide grains are dispersed in gelatin (redissolving).

After adding the spectral sensitizing dyes to the silver halide grains of the invention, chemical ripening is carried out by adding sensitizers. Usable sensitizers include active gelatins, sulfur sensitizers such as allyl thiocarbamide, thiourea, cystine; selenium sensitizers; reducing sensitizers such as stannous salts, thiourea dioxide, polyamines; noble metal sensitizers such as gold sensitizers including potassium aurothiacyanate, potassium chloroaurate, 2-aurothio-3-methylbenzothiazolium chloride and sensitizers comprising water soluble salts of ruthenium, palladium, platinum, rhodium and iridium including ammonium chloropalladate, potassium chloroplatinate, sodium chloropalladate (some of them function as a sensitizer or as a fog inhibitor depending upon the amount used). These are used singly or in combination (e.g., combination of gold sensitizer and sulfur sensitizer or that of gold sensitizer and selenium sensitizer).

The average grain size of the silver halide grains formed in the invention is not particularly limited and may be varied according to uses, but it is preferably 0.2 to 1.6 μm and especially 0.25 to 1.2 μm. An average grain size smaller than 0.2 μm lowers the sensivity at times, and that larger than 1.6 μm deteriorates the rate of developing at times.

The term "grain size $\bar{r}$" means the length of an edge for cubic silver halide grains, and the length of an edge of a cube converted to the same volume for non-cubic grains. And, when the size of each grain so-defined is denoted by ri and the total number of measured grains by n, the average grain size is expressed by $$\text{Average grain size } \bar{r} = \frac{\Sigma ri}{n}$$

The silver halide grains of the invention may be of polydispersion having a wide grain size distribution or of monodispersion having a very narrow grain size distribution. But those of monodispersion are preferred.

"Monodispersed silver halide grains of the invention" mean grains which have, for the most part, the same form and much the same size when examined by electronography, and have a variation coefficient not more than 0.15, which is given by dividing the standard deviation S of grain size distribution by the average grain size $\bar{r}$ as defined by the following expression:

$$\text{Standard deviation } S = \sqrt{\frac{\Sigma(\bar{r} - ri)^2 ni}{\Sigma ni}}$$

$$\text{Variation coefficient} = \frac{S}{r}$$

where ri is the size of each grain, and ni is the number of grains having a size of ri.

It is desirable that the silver halide grains used in the invention have a silver chloride content not less than 90 mol %. More desirably, the silver bromide content is not more than 10 mol % and the silver iodide content is not more than 0.5 mol %. The most desirable silver halide composition is a silver chloride having a silver bromide content of 0.1 to 2 mol %.

These silver halide grains may be used singly or in combination with other types of silver halide grains different in composition. These may also be used together with silver halide grains having a silver chloride content less than 90 mol %.

In the silver halide emulsion layer having a silver chloride content not less than 90 mol %, the weight percentage of silver halide grains having a silver chloride content not less than 90 mol % is usually 60% or more, preferably 80% or more of the total weight of silver halide grains contained in said emulsion layer.

In order to improve the initial stability of latent images, it is preferable that iridium compounds or compounds of group Va, VIa, VIIa or VIII metals other than iridium be added to the silver halide grains in the course of silver halide formation (in one of the processes of nucleus formation, grain growth and physical ripening).

In practice, these iridium compounds are added in various manners; that is, by addition to a mother liquor before nucleus formation, rush addition during silver halide formation, pre-addition to a halide solution or a soluble silver salt solution used for grain growth, and addition after grain growth and immediately before physical ripening. Further, in a method for manufacturing emulsions in which silver halide grains are formed and grown by feeding silver halide fine grains, iridium salts may be added during the manufacture of such silver halide fine grains, then the fine grains so-prepared are added in a reaction vessel to form a prescribed silver halide.

The iridium compounds may be added in parts with the change of stages. These may also be added as a mixed solution containing two or more kinds of iridium compounds. Further, these may be added as two or more solutions respectively containing different kinds of iridium compounds as stages change.

The compounds of metals other than iridium may also be added part by part in different stages, or in the form of a mixed solution containing plural kinds of metal compounds, or may be added as two or more solutions respectively containing different metal compounds according to the change of stages.

The iridium compounds used in the invention are not particularly limited in kinds. But, in view of the stability, safety and economy of the compounds, halogenated iridium(III) compounds, halogenated iridium(IV) compounds, and iridium complex salts having as ligands halogens, amines or oxalates are preferred. Typical examples thereof are shown below, but the invention is by no means limited by them.

Iridium trichloride, iridium tribromide, potassium hexachloroiridate (III), ammonium iridium(III) sulfate, potassium iridium(III) disulfate, tripotassium iridium(III) trisulfate, iridium(III) sulfate, iridium(III) trioxalate, potassium hexacyanoiridium (III), iridium tetrachloride, iridium tetrabromide, potassium hexachloroiridate(IV), ammonium hexachloroiridate(IV), potassium iridate(IV), iridium (IV) trioxalate and potassium hexacyanoiridium(IV).

In the invention, any of these compounds can be used, and any of them can be combined when necessary. These compounds are mostly used as an aqueous solution or a solution of a water-miscible solvent; accordingly, there may be employed a well-known method for stabilizing an iridium compound solution, namely, addition of a hydrogen halide (e.g., hydrogen chloride, hydrogen bromide), a halogenated alkali (e.g., potassium chloride, sodium chloride, potassium bromide) or nitric acid.

The addition amount of the iridium compound is not less than $10^{-11}$ mol per mol of silver halide, preferably not less than $10^{-9}$ mol for bringing out the effect of the invention satisfactorily. And, in view of fogging and desensitization, it is preferably not more than $5\times10^{-6}$ mol, especially not more than $5\times10^{-6}$ mol.

The term "metal" in "group Va, VIa, VIIa or VIII metals other than iridium" used in the invention indicates vanadium, chromium, manganese, iron, cobalt, nickel, niobium, technetium, ruthenium, rhodium, palladium, tantalum, rhenium, osmium and platinum, and a compound of any of those metals can be used in the invention. Complex salts of such a compound can also be used. The ligand of the complex salt may be any of chlorine, bromine, iodine, amine, cyan, thiocyan and acetylacetone. The following are examples thereof, but the invention is not limited to them.

Vanadium dichlorooxide, vanadium oxyoxide, vanadium oxosulfate, vanadium oxide acetylacetate, chromium(III) chloride, chromium (III) bromide, chromium (III) nitrate, chromium(III) acetate, potassium chromium(III) sulfate, manganese (II) acetate, ammonium manganese (II) sulfate, manganese (II) bromide, manganese (II) carbonate, manganese (II) chloride, iron (II) chloride, iron (III) chloride, iron (II) sulfate, iron (III) sulfate, Mohr's salt, red prussiate, yellow prussiate, iron (II) thiocyanate, iron (III) thiocyanate, iron (II) bromide, iron (III) bromide, iron (II) acetate, iron (III) acetate, pentacyano aremine iron (II), cobalt (II) chloride, cobalt (III) chloride, cobalt (II) acetate, hexaammine cobalt (III) chloride, cobalt (II) nitrate, nickel (II) chloride, nickel (II) oxalate, nickel (II) bonzoate, nickel (II) cyanide, niobium(V) chloride, ruthenium(III) chloride, ruthenium(III) acethylacetate, rhodium(III) chloride, rhodium(III) nitrate, rhodium(III) acetate, palladium(II) acetate, palladium(II) acetylacetate, ammonium palladium(II) chloride, palladium(II) chloride, tantalum (V) chloride, chloroplatinic (IV) acid, platinum(IV) chloride, potassium tetrachloroplatinate (II), osmic (VIII) acid, potassium hexathiocyanato rhenium(II), potassium hexacyanato ruthenium(II), potassium hexathiocyanato ruthenium(III), potassium pentacyanochloro ruthenium(II), sodium pentachloronitrosyl ruthenium(II), and potassium pentabromonitrosyl osmium(IV).

In the invention, suitable compounds can be arbitrarily selected from the above compounds, and these may also be used in combination if necessary.

The addition amount of the compounds of metals other than iridium is not less than $10^{-10}$ mol, preferably not less than $10^{-8}$ mol per mol of silver halide for fully bringing out the effect of the invention. On the contrary, in view of fogging and desensitization, the addition amount is preferably not more than $5\times10^{-3}$ mol, especially not more than $5\times10^{-4}$ mol.

It is preferable that these iridium compounds and compounds of metals other than iridium be concurrently present while silver halide grains are formed.

When a silver halide emulsion prepared according to the method of the invention is used in a color photographic light-sensitive material, there are employed, in color developing process, dye-forming couplers which undergo coupling with an oxidation product of an aromatic primary amine developing agent (e.g., p-phenylenediamine derivatives, aminophenol derivatives) to form dyes.

Such couplers are usually selected so as to form dyes which absorb sensitive spectral light of respective emulsion layers; that is, yellow dye forming couplers are used in a blue-sensitive emulsion layer, magenta dye forming couplers in a green-sensitive emulsion layer, and cyan dye forming couplers in a red-sensitive emulsion layer. However, the above combination may be altered according to a requirement of a color photographic light-sensitive material to be manufactured.

It is desired that these dye forming couplers have in their molecules the so-called ballast group having 8 or more carbon atoms which prevents the couplers from diffusing. These dye forming couplers may be either four-equivalent ones which require four silver ions to be reduced for forming one dye molecule, or two-equivalent ones which require only two silver ions to be reduced.

Preferred yellow dye forming couplers include various acyl acetanilide type couplers. Among them, benzoyl acetanilide compounds and pivaloyl acetanilide compounds are preferred.

Preferred magenta dye forming couplers are 5-pyrazolone type couplers, pyrazolobenzimidazole type couplers, pyrazoloazole type couplers, and open-chain acyl acetonitrile type couplers.

Preferred cyan dye forming couplers are naphthol type couplers and phenol type couplers.

These dye forming couplers are usually dissolved in a high boiling organic solvent having a boiling point of 150° C. about or more or in a water insoluble high molecular compound, in combination with a low boiling and/or water soluble organic solvent if necessary. The solution is dispersed in a hydrophilic binder such as an aqueous solution of gelatin with the aid of a surfactant, then it is added in a desired emulsion layer of a photographic light-sensitive material. There may be provided a process to remove the low boiling organic solvent after the dispersing or concurrently with the dispersing.

Dielectric constant of the high boiling organic solvent is not more than 6.5. Examples of such a solvent include esters such as phthalates and phosphates, organic acid amides, ketones and hydrocarbons each having a dielectric constant not more than 6.5. More desirable solvents are high boiling organic solvents having a dielectric constant not more than 6.5 and not less than 1.9 and a vapor pressure not higher than 0.5 mmHg at 100° C. Among these, phthalates and phosphates are most desirable. Particularly, dialkyl phthalates having alkyl groups each containing 9 or more carbon atoms are used most advantageously. These high boiling solvent may be a mixture of two or more kinds.

The dielectric constant used here is a dielectric constant measured at 30° C.

These high boiling organic solvents are used in an amount of generally 0 to 400 wt %, preferably 10 to 100 wt % of couplers.

Silver halide emulsions prepared according to the invention are coated on supports to make, for example, negative and positive films for color negatives, and color photographic paper. Especially, the effect of the invention is advantageously revealed when the invention is applied to the manufacture of color photographic paper directly used in color printing.

The silver halide photographic light-sensitive materials including the color photographic paper, which employ the emulsion of the invention; may be either monochromatic ones or multicolor ones.

As a binder for the silver halide emulsion of the invention, gelatin is preferably used.

Usually, gelatin used in the photographic industry is manufactured from ox bones, oxhides or pigskins and falls into two types by manufacturing processes starting with collagen: alkali-treated gelatins subjected to treatment with lime or the like, and acid-treated gelatins subjected to treatment with hydrochloric acid or the like.

The acid treatment in the manufacture of acid-treated gelatins is clearly distinguished from the pH adjustment in the preparation of dispersions of the invention.

Details of the manufacture and properties of such gelatins are described, for example, in Arthur Veis, "The Macromolecular Chemistry of Gelatin", Academic Press, pp 187–217 (1964), T.H. James, "The Theory of the Photographic Process", 4th ed., Macmillan, p. 55 (1977), "Handbook of Photographic Science", Part 1, Maruzen, pp. 72–75, and "The Elements of Photographic Engineering—Silver Salt Photography", Corona Co., pp.119–124.

Gelatin used in the silver halide emulsion of the invention may be either a lime-treated gelatin or an acid-treated gelatin and may be manufactured from any of ox bones, oxhides and pigskins; but, a lime-treated gelatin manufactured from ox bones is preferred.

Photographic emulsion layers, in which the silver halide emulsion of the invention is used, and other hydrophilic colloid layers of a photographic light-sensitive material are hardened by single or combined use of hardeners which crosslink binder (or protective colloid) molecules to enhance the coating strength. It is preferable that these hardeners be contained in the above layers in an amount large enough to harden the light-sensitive material without a further addition of them to a processing solution. But these may be added to a processing solution.

For preventing fogs caused by discharge resulting from frictional electrification of a light-sensitive material and for inhibiting the deterioration of images due to ultraviolet rays, a hydrophilic colloid layer such as a protective layer or an intermediate layer may contain a UV absorbent.

The photographic light-sensitive matarial made by use of the silver halide emulsion according to the invention may have auxiliary layers such as a filter layer, an antihalation layer and/or an anti-irradiation layer. These layers and/or emulsion layers may contain a dye which is washed out of a color light-sensitive material or bleached during development.

For the purposes of reducing gloss, enhancing retouchability and preventing adhesion of light-sensitive materials made by use of the emulsion of the invention, a matting agent may be incorporated in silver halide emulsion layers and other hydrophilic colloid layers. A slipping agent for reducing sliding friction and an antistatic agent for preventing static charge may also be added therein.

Further, there may be added various surfactants in photographic emulsion layers and/or other hydrophilic colloid layers for the purposes of improving coatability, antistatic property, slipperiness, emulsification and dispersion, anti-adhesion and other photographic properties (development acceleration, contrast, sensitization, etc.).

The emulsion prepared according to the invention may be coated on baryta paper, paper laminated with an $\alpha$-olefin polymer, a paper support laminated with an easily removal $\alpha$-olefin polymer layer, a flexible and reflective support such as synthetic paper, film of a semi-synthetic or synthetic polymer such as acetylcellulose, nitrocellulose, polystyrene, polyvinyl chloride, polyethylene terephthalate, polycarbonate or polyamide, a reflective support obtained by coating a white pigment on such film, and a rigid body of glass, metal or porcelain. The emulsion may also be coated on a thin reflective support of 120 to 160 $\mu$m thick.

These supports may be either reflective or transparent, and a white pigment may be contained in these supports to give reflectivity, or may be coated on them in the form of a hydrophilic colloid layer.

These supports may be subjected to corana discharge, ultraviolet ray irradiation or flame treatment before being coated with the emulsion of the invention, and then coated directly with the emulsion or firstly with a subbing layer (comprising one or more layers for improving the surface adhesion, antistatic property, dimensional stability, abrasion resistance, hardness, antihalation property, frictional characteristics and other characteristics).

The silver halide emulsion of the invention may use a thickener for the improvement in coatability.

In the invention, color developing agents used in a color developer are conventional ones widely employed in a variety of color photographic processes.

In the invention, the light-sensitive material may be processed with a processing solution having a bleaching ability immediately after color developing, or said processing solution having a bleaching ability may be a processing solution having a fixing ability (the so-called bleach-fixer). As a bleaching agent in such a bleaching process, a metal complex salt of an organic acid is used.

EXAMPLES

Example 1

The following solutions A and B were simultaneously added over a period of 30 minutes to 1000 ml of 2% aqueous solution of gelatin kept at 40° C, while controlling the pAg at 6.0 and the pH at 3.0. Then, the following solutions C and D were simultaneously added thereto over a period of 180 minutes, keeping the liquor at pAg 6.3 and pH 5.5. The control of the pAg during the addition was made according to the method disclosed in Japanese Pat. O.P.I. Pub. No. 45437/1984, and the control of the pH was made by use of sulfuric acid and an aqueous solution of sodium hydroxide.

| | | |
|---|---|---|
| Solution A | Sodium chloride | 3.42 g |
| | Potassium bromide | 0.03 g |
| | Water was added to make | 200 ml |
| Solution B | Silver nitrate | 10 g |
| | Water was added to make | 200 ml |
| Solution C | Sodium chloride | 102.7 g |
| | Potassium bromide | 1.0 g |
| | Water was added to make | 600 ml |
| Solution D | Silver nitrate | 300 g |
| | Water was added to make | 600 ml |

After completing the addition, desalting was conducted by use of a 5% aqueous solution of Demol N (Kao-Atlas Co.) and a 20% aqueous solution of magnesium sulfate. Then the resulting silver halide grains were mixed with an aqueous solution of gelatin. In this way, a monodipersed cubic grain emulsion EMO comprised of grains having an average grain size of 0.43 $\mu$m, a variation coefficient ($\sigma/\bar{r}$) of 0.08 and a silver chloride content of 99.5 mol % was obtained. A spectral sensitizing dye was added to emulsion EMO at the temperature and in the addition time shown in Table 1. The emulsion was heated to 60° C and then chemically ripened for 120 minutes by adding 1.5 mg/mol Ag of sodium thiosulfate, 1.0 mg/mol Ag of chloroauric acid and $6\times10^{-4}$ mol/mol Ag of a stabilizer (STAB-1), in this way, a green-sensitive silver halide emulsion was obtained.

To the emulsion obtained were added sodium dodecylbenzenesulfonate as coating aid and a hardener (H-2) in amounts of 10 mg/g gelatin, respectively. Then, the emulsion was coated on a polyethylene terephthalate support so as to give a silver coating weight of 4.0 g/m$^2$ and a gelatin coating weight of 5.0 g/m$^2$.

Further, a protective layer was formed thereon by coating 2.0 g/m$^2$ of gelatin to obtain a sample of light-sensitive material. Sample Nos. 1 to 11 different in addition conditions of the sensitizing dye were prepared by repeating the above procedure. Each sample was exposed by use of a Sensitometer Model KS-7 (Konica Corp.) and processed as follows:

| Process | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

| Color developer | |
|---|---|
| Water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxylethylidene-1,1-diphosphonic acid | 1.0 g |

-continued

| | |
|---|---|
| Ethylenediaminetetracetic acid | 1.0 g |
| Disodium catechol-3,5-diphosphonate | 1.0 g |
| N-ethyl-N-β-methanesulfonamidoethyl-3-methyl-4-aminoaniline sulfate | 4.5 g |
| Optical whitening agent (4,4'-diaminostilbene-sulfonic acid derivative) | 1.0 g |
| Potassium carbonate | 27 g |

Water was added to make a total of 1 liter, and the pH was adjusted to 10.10.

| Bleach-fixer | |
|---|---|
| Diammonium ferric ethylenediaminetetracetate dihydrate | 60 g |
| Ethylenediaminetetracetic acid | 3 g |
| Ammonium thiosulfate (70% solution) | 100 ml |
| Ammonium sulfite (40% solution) | 27.5 ml |

Water was added to make a total of 1 liter, and the ph was adjusted to 5.7 with potassium carbonate and glacial acetic acid.

| Stabilizer | |
|---|---|
| 5-Chloro-2-methyl-4-isothazoline-3-one | 1.0 g |
| Ethylene glycol | 1.0 g |
| 1-Hydroxyethylidene-1,1-diphosphoinic acid | 2.0 g |
| Ethylenediaminetetracetic acid | 1.0 g |
| Ammonium hydroxide (20% aqueous solution) | 3.0 g |
| Optical whitening agent (4,4'-diaminostilbene sulfonic acid derivative | 1.5 g |

Water was added to make a total of 1 liter, then the pH was adjusted to 7.0 with sulfuric acid and potassium hydroxide.

After the processing, the gradation and the Dmax value were measured with a Densitometer Model PDA-65 (Konica Corp.). "The gradation" used here is a value indicating the gradation given as a reciprocal of the difference in logarithm between the exposure to give, a density of 1.0 and that to give a density of 2.0. And the larger the value is, the harder the gradation becomes. "The Dmax value" is a value at the maximum reflected density point on a sensitometry curve. The results are shown in Table 1.

TABLE 1

| Sample. No | Spectral Sensitizing Dye (II-11) $4 \times 10^{-4}$ mol/mol Ag: Addition Temperature (°C.) | Addition Time (sec) | Chemical Ripening Temperature (°C.) | Gradation | Dmax Value | |
|---|---|---|---|---|---|---|
| 1 | 40 | 30 | 60 | 3.12 | 2.53 | Invention |
| 2 | 40 | 60 | 60 | 3.12 | 2.53 | Invention |
| 3 | 40 | 90 | 60 | 3.14 | 2.53 | Invention |
| 4 | 50 | 30 | 60 | 3.07 | 2.51 | Invention |
| 5 | 50 | 60 | 60 | 3.08 | 2.51 | Invention |
| 6 | 50 | 90 | 60 | 3.09 | 2.52 | Invention |
| 7 | 60 | 30 | 60 | 2.61 | 2.34 | Comparison |
| 8 | 60 | 60 | 60 | 2.50 | 2.32 | Comparison |
| 9 | 60 | 90 | 60 | 2.30 | 2.20 | Comparison |
| 10 | Before completion of physical ripening, 50 C (chemically ripened after being kept in a refrigerator for 5 days) | 60 | 60 | 3.08 | 2.51 | Comparison |
| 11 | Before completion of physical ripening, 50 C (immediately chemically ripened) | 60 | 60 | 2.97 | 2.46 | Comparison |

As apparent from Table 1, addition of the spectral sensitizing dye under the conditions specified by the invention minimizes the fluctuation in gradation and thereby provides a high production stability, and it also gives a high contrast and a high Dmax value. The sensitometry curve shown in FIG. 1 also indicates that a high Dmax value and a good linearity can be obtained.

Example 2

The same procedure as in Example 1 was repeated, except that the addition time of solutions A and B and that of solutions C and D were changed. Thus, a monodispersed cubic grain emulsion EMR comprised of grains having an average grain size of 0.85 μm, a variation coefficient ($\sigma/\bar{r}$) of 0.07 and a silver chloride content of 99.5 mol % was obtained. Next, the spectral sensitizing dye shown in 2 was added thereto in 60 seconds at 58° C. And after adding 0.8 mg/mol Ag of sodium thiosulfate, 0.5 mg/mol Ag of chloroauric acid and $6\times10^{-4}$ mol/mol Ag of stabilizer (STAB-1) at the same temperature, the emulsion was chemically ripened for 90 minutes to obtain a blue-sensitive silver halide emulsion EMR-1.

Blue-sensitive silver halide emulsions EMR-2 to EMR-4 were prepared in the same procedure as with EMR-1, except that the spectral sensitizing dye 2 was added at 40° C and then the emulsion temperature was raised to 58° C.

The spectral sensitizing die showe in Table 2 was added to emulsion EMO in 60 seconds at 60° C. After adding 1.5 mg/mol Ag of sodium thiosulfate, 1.0 mg/mol Ag of chloroauric acid and $6\times10^{-4}$ mol/mol Ag of stabilizer (STAB-1) thereto, the emulsion was chemically ripened for 120 minutes to obtain a green-sensitive silver halide emulsion EMO-1. EMO-2 to EMO-5 were prepared by repeating the procedure for EMO-1, except that the spectral sensitizing dye was added at 40° C. and then emulsion temperature was raised to 60° C.

A monodispersed cubic grain emulsion EMP was prepared in the same procedure as with EMO, except that the addition time of solutions A and B and that of solutions C and D were changed. Emulsion EPM thus obtained was comprised of grains having an average grain size of 0.5 μm, a variation coefficient ($\sigma/\bar{r}$) of 0.08 and a silver chloride content of 99.5 mol %. After adding the spectral sensitizing dye shown in Table 2 thereto in 60 seconds at 60° C., 1.8 mg/mol Ag of sodium thiosulfate, 2.0 mg/mol Ag of chloroauric acid and $6\times10^{-4}$ mol/mol Ag of stabilizer (STAB-1) were further added, then the emulsion was chemically ripened for 100 minutes to obtain a red-sensitive silver halide emulsion EMP-1.

Red-sensitive silver halide emulsions EMP-2 and EMO-3 were prepared by repeating the procedure with EMP-1, except that the spectral sensitizing dye was added at 40° C. and then emulsion temperature was raised to 60° C.

Emulsion EMRX was prepared under the same conditions as with EMR, except that $5\times10^{-8}$ mol/mol Ag of potassium iridate(IV) and $1\times10^{-5}$ mol/mol Ag of yellow prussiate of potash were added.

EMRX-1 was prepared by subjecting EMRX to chemical ripening under the same condition as EMR-1, and EMRX-2 was prepared by subjecting EMRX to chemical ripening under the same condition as with EMR-2. Further, EMOX and EMPX were prepared under the same conditions as with EMO and EMP, except that $5\times10^{-8}$ mol/mol Ag of potassium iridate-(IV) and $1\times10^{-5}$ mol/mol Ag of yellow prussiate of potash were added. EMOX-1 was prepared by subjecting EMOX to chemical ripening under the same condition as with EMO-1, and EMPX-1 was prepared by subjecting EMPX to chemical ripening under the same condition as with EMP-1. Further, EMOX-2 and EMPX-2 were prepared by subjecting EMOX and EMPX to the same chemical ripenings as with EMO-2 and EMP-2, respectively.

After adding the spectral sensitizing dye to EMPX, the chemical ripening was performed under the same condition to obtain EMPX-3, except that the pAg was raised to 7.0. Further, EMOX-3 and EMPX-3 were prepared by subjecting EMOX and EMPX to chemical ripening under the same conditions as with EMOX-2 and EMPX-2, respectively, except that the pAg was raised to 7.0 after the addition of the spectral sensitizing dye. The emulsions thus prepared were respectively coated in the following procedure to obtain light-sensitive materials for evaluation.

A multilayer silver halide color photographic light-sensitive material was prepared by forming the following component layers on the titanium-oxide-containing polyethylene layer of a paper support laminated with polyethylene on one side and with titanium-oxide-containing polyethylene on the other side.

Coating Solution for 1st layer

There was dissolved a mixture of 26.7 g of yellow coupler (Y-1), 10.0 g of dye image stabilizer (ST-1), 6.67 g of dye image stabilizer (ST-2), 0.67 g of additive (HQ-1) and 6.67 g of high boiling solvent (DNP) by adding 60 ml of ethyl acetate thereto. Then, the solution was dispersed with a supersonic homogenizer in 220 ml of 10% aqueous solution of gelatin containing 7 ml of 20% surfactant (SU-1) to obtain a yellow coupler dispersion. This dispersion was mixed with a blue-sensitive silver halide emulsion (containing 10 g of silver). A coating solution for the 1st layer was thus obtained.

Coating solutions for the 2nd to 7th layers were prepared in the same manner as the above.

In addition, there were added hardener (H-1) in the 2nd and 4th layers and hardener (H-2) in the 7th layer. And surfactants (SU-2) and (SU-3) were added as coating aids for adjusting surface tension.

| Layer | Component | Amount Added (g/m$^2$) |
|---|---|---|
| 7th layer (protective layer) | gelatin | 1.00 |
| | antistain agent (HQ-2) | 0.002 |
| | antistain agent (HQ-3) | 0.002 |
| | antistain agent (HQ-4) | 0.004 |
| | antistain agent (HQ-5) | 0.02 |
| | DIDP | 0.005 |
| | fungicide (F-1) | 0.002 |
| 6th layer (UV absorbing layer) | gelatin | 0.40 |
| | UV absorbent (UV-1) | 0.10 |
| | UV absorbent (UV-2) | 0.04 |
| | UV absorbent (UV-3) | 0.16 |
| | Antistain agent (HQ-5) | 0.04 |
| | DNP | 0.20 |
| | PVP | 0.03 |
| | anti-irradiation dye (AI-2) | 0.02 |
| | anit-irradiation dye (AI-4) | 0.01 |
| 5th layer (red-sensitive layer) | gelatin | 1.30 |
| | red-sensitive silver bromide emulsion | 0.21 |
| | cyan couper (C-1) | 0.17 |
| | cyan couler (C-2) | 0.25 |
| | dye image stabilizer (ST-1) | 0.20 |
| | antistain agent (HQ-1) | 0.01 |
| | HBS-1 | 0.20 |
| | DOP | 0.20 |
| 4th layer (UV absorbing layer) | gelatin | 0.94 |
| | UV absorbent (UV-1) | 0.28 |
| | UV absorbent (UV-2) | 0.09 |
| | UV absorbent (UV-3) | 0.38 |
| | antistain agent (HQ-5) | 0.10 |
| | DNP | 0.40 |
| 3rd layer (green-sensitive layer) | gelatin | 1.40 |
| | green-sensitive silver bromide emulsion | 0.17 |
| | magenta coupler (M-1) | 0.23 |
| | dye image stabilizer (ST-3) | 0.20 |
| | dye image stabilizer (ST-4) | 0.17 |
| | DIDP | 0.13 |
| | DBP | 0.13 |
| | anti-irradiation dye (AI-1) | 0.01 |
| 2nd layer (intermediate layer) | gelatin | 1.20 |
| | antistain agent (HQ-2) | 0.03 |

-continued
| | | |
|---|---|---|
| | antistain agent (HQ-3) | 0.03 |
| | antistain agent (HQ-4) | 0.05 |
| | antistain agent (HQ-5) | 0.23 |
| | DIDP | 0.06 |
| | fungicide (F-1) | 0.002 |
| 1st layer (blue-sensitive layer) | gelatin | 1.20 |
| | blue-sensitive silver bromide emulsion | 0.26 |
| | yellow coupler (Y-1) | 0.80 |
| | dye image stabilizer (ST-1) | 0.30 |
| | dye image stabilizer (ST-2) | 0.20 |
| | antistain agent (HQ-1) | 0.02 |
| | anti-irradiation dye (AI-3) | 0.01 |
| | DNP | 0.20 |
| support | polyethyle laminated paper | |
M-1
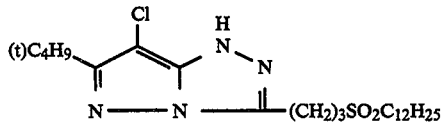
C-1
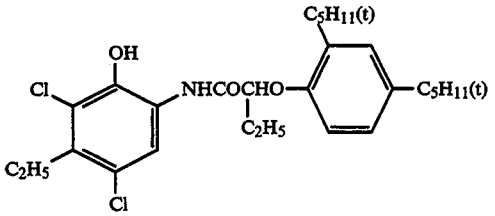
C-2
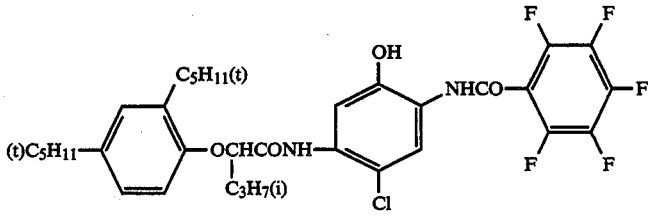
ST-1
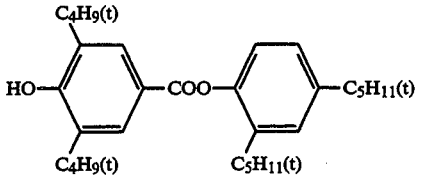
ST-2
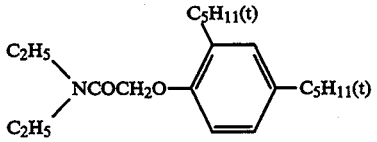
ST-3
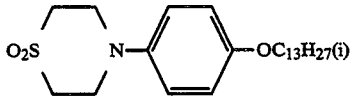
ST-4
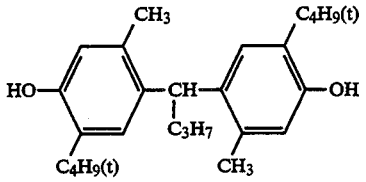

-continued
UV-1
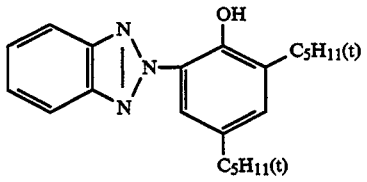
UV-2
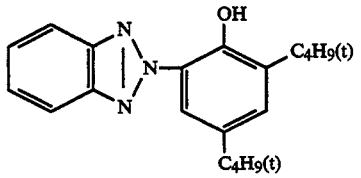
UV-3
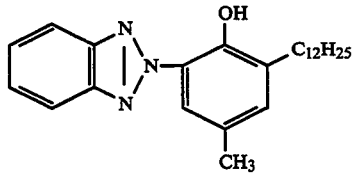
DBP: dibutyl phthalate
DOP: dicotyl phthalate
DNP: dinonyl phthalate
DIDP: diisodecyl phthalate
PVP: polyvinyl pyrrolidone
HQ-1
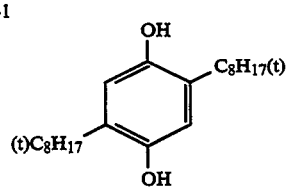
HQ-2
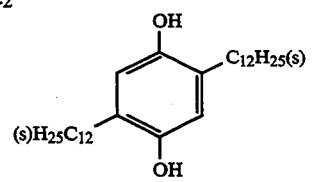
HQ-3
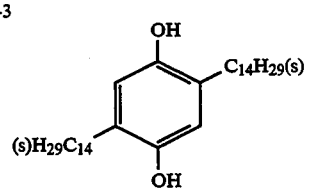
HQ-4
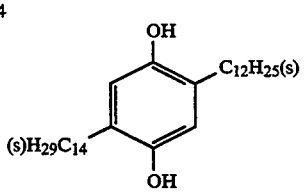
HQ-5
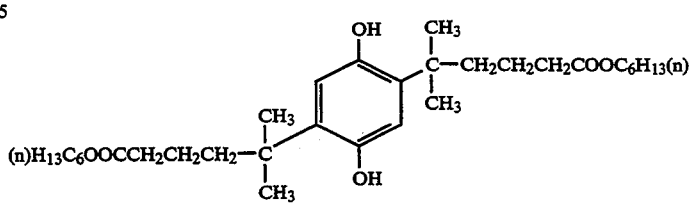
HBS-1
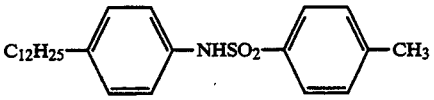

-continued
AI-1
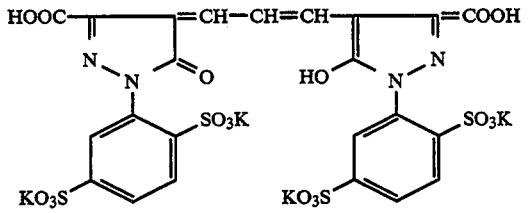
AI-2
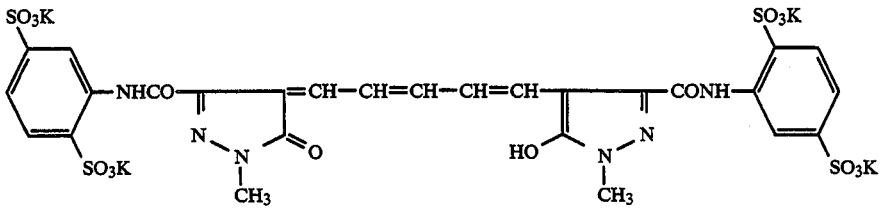
AI-3
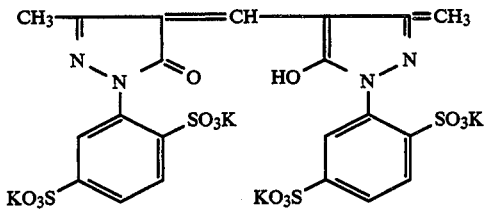
AI-4
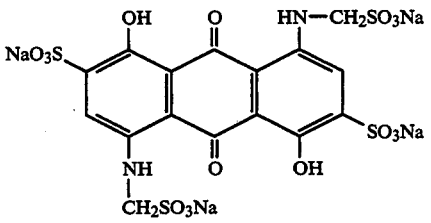
SU-1
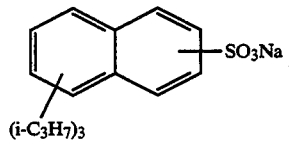
SU-2
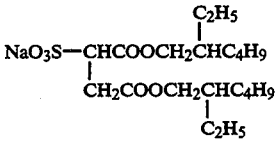
SU-3
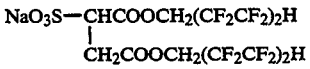
H-1
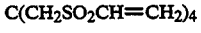
H-2
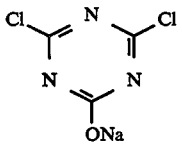

-continued

F-1

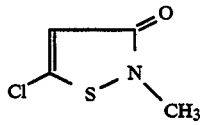

The results obtained are shown in Table 3.

The latent image stability in the table is shown by a value obtained by steps of exposing a sample with a Sensitometer Model KS-7 (Konica Corp.), processing it with different time intervals of 10 seconds and 5 minutes between exposing and processing, and recording the sensitometry sensitivity obtained with the 5-minute time interval in a value relative to the sensitometry sensitivity obtained with the 10-second time interval, which was set at 100.

The exposing temperature dependency was evaluated by use of the Sensitometer Model KS-7 (Konica Corp.); that is, a sample was conditioned for 2 hours at 10° C. and 50% humidity in the sensitometer's conditioning chamber and exposed and processed, then the sensitivity obtained was taken as 100, separately a sample was conditioned for 2 hours at 30° C. and 50% humidity, followed by exposing and processing, and the sensitivity obtained was recorded in a value relative to the above. The exposing humidity dependency was evaluated as the exposing temperature dependency; that is, a sample was conditioned for 2 hours at 20° C. and 15% humidity in the conditioning chamber of the sensitometer, followed by exposing and processing, and the sensitivity obtained was taken as 100, separately a sample was conditioned for 2 hours at 20° C. and 85% humidity, followed by exposing and processing, then the sensitivity obtained was recorded in a value relative to the above.

TABLE 2

| | Emulsion No. | | | Spectral Sensitizing Dye (mol/mol Ag) | | |
|---|---|---|---|---|---|---|
| Sample No | Blue-sensitive Layer | Green-sensitive Layer | Red-sensitive Layer | Blue-sensitive Emulsion | Green-sensitive Emulsion | Red-sensitive Emulsion |
| 12 | EMR-1 | EMO-1 | EMP-1 | I-14 $4 \times 10^{-4}$<br>I-31 $1 \times 10^{-4}$ | II-11<br>$4 \times 10^{-4}$ | III-41<br>$1 \times 10^{-4}$ |
| 13 | EMR-2 | EMO-2 | EMP-2 | I-14 $4 \times 10^{-4}$<br>I-31 $1 \times 10^{-4}$ | II-11<br>$4 \times 10^{-4}$ | III-41<br>$1 \times 10^{-4}$ |
| 14 | EMR-3 | EMO-2 | EMP-2 | I-7 $4 \times 10^{-4}$ | II-11<br>$4 \times 10^{-4}$ | III-41<br>$1 \times 10^{-4}$ |
| 15 | EMR-4 | EMO-2 | EMP-2 | I-28 $2 \times 10^{-4}$<br>I-29 $2 \times 10^{-4}$ | II-11<br>$4 \times 10^{-4}$ | III-41<br>$1 \times 10^{-4}$ |
| 16 | EMR-2 | EMO-3 | EMP-2 | I-14 $4 \times 10^{-4}$<br>I-31 $1 \times 10^{-4}$ | II-7<br>$3 \times 10^{-4}$ | III-41<br>$1 \times 10^{-4}$ |
| 17 | EMR-2 | EMO-4 | EMP-2 | I-14 $4 \times 10^{-4}$<br>I-31 $1 \times 10^{-4}$ | II-28<br>$2 \times 10^{-4}$<br>II-29<br>$2 \times 10^{-4}$ | III-41<br>$1 \times 10^{-4}$ |
| 18 | EMR-2 | EMO-5 | EMP-3 | I-14 $4 \times 10^{-4}$<br>I-31 $1 \times 10^{-4}$ | II-11<br>$4 \times 10^{-4}$ | III-29<br>$0.9 \times 10^{-4}$ |
| 19 | EMR-4 | EMO-4 | EMP-3 | I-28 $2 \times 10^{-4}$<br>I-29 $2 \times 10^{-4}$ | II-28<br>$2 \times 10^{-4}$<br>II-29<br>$2 \times 10$ | III-29<br>$0.9 \times 10^{-4}$ |
| 20 | EMRX-1 | EMOX-1 | EMPX-1 | I-14 $4 \times 10^{-4}$<br>I-31 $1 \times 10^{-4}$ | II-11<br>$4 \times 10^{-4}$ | III-41<br>$1 \times 10^{-4}$ |
| 21 | EMRX-2 | EMOX-2 | EMPX-2 | I-14 $4 \times 10^{-4}$<br>I-31 $1 \times 10^{-4}$ | II-11<br>$4 \times 10^{-4}$ | III-41<br>$1 \times 10^{-4}$ |
| 22 | EMRX-3 | EMOX-3 | EMPX-3 | I-14 $4 \times 10^{-4}$<br>I-31 $1 \times 10^{-4}$ | II-11<br>$4 \times 10^{-4}$ | III-41<br>$1 \times 10^{-4}$ |

| | Temperature at the Addition of Spectral Sensiziting Dye | | | pAg after the Addition of Spectral Sensitizing Dye | | |
|---|---|---|---|---|---|---|
| Sample No | Blue-sensitive Emulsion | Green-sensitive Emulsion | Red-sensitive Emulsion | Blue-sensitive Emulsion | Green-sensitive Emulsion | Red-sensitive Emulsion |
| 12 | 58° C. | 60° C. | 60° C. | 6.3 | 6.3 | 6.3 |
| 13 | 40° C. | 40° C. | 40° C. | 6.3 | 6.3 | 6.3 |
| 14 | 40° C. | 40° C. | 40° C. | 6.3 | 6.3 | 6.3 |
| 15 | 40° C. | 40° C. | 40° C. | 6.3 | 6.3 | 6.3 |
| 16 | 40° C. | 40° C. | 40° C. | 6.3 | 6.3 | 6.3 |
| 17 | 40° C. | 40° C. | 40° C. | 6.3 | 6.3 | 6.3 |
| 18 | 40° C. | 40° C. | 40° C. | 6.3 | 6.3 | 6.3 |
| 19 | 40° C. | 40° C. | 40° C. | 6.3 | 6.3 | 6.3 |
| 20 | 58° C. | 60° C. | 60° C. | 6.3 | 6.3 | 6.3 |

TABLE 2-continued

| | | | | | | |
|---|---|---|---|---|---|---|
| 21 | 40° C. | 40° C. | 40° C. | 6.3 | 6.3 | 6.3 |
| 22 | 40° C. | 40° C. | 40° C. | 7.0 | 7.0 | 7.0 |

TABLE 3

| | Gradation | | | Dmax | | | Latent Image Stability | | |
|---|---|---|---|---|---|---|---|---|---|
| Sample No. | Blue-sensitive Layer | Green-sensitive Layer | Red-sensitive Layer | Blue-sensitive Layer | Green-sensitive Layer | Red-sensitive Layer | Blue-sensitive Layer | Green-sensitive Layer | Red-sensitive Layer |
| 12 | 2.80 | 2.74 | 3.10 | 2.40 | 2.47 | 2.60 | 110 | 120 | 113 |
| 13 | 3.02 | 3.21 | 3.41 | 2.50 | 2.65 | 2.74 | 108 | 111 | 110 |
| 14 | 3.00 | 3.21 | 3.41 | 2.49 | 2.65 | 2.74 | 106 | 112 | 110 |
| 15 | 3.03 | 3.22 | 3.42 | 2.50 | 2.66 | 2.74 | 107 | 111 | 109 |
| 16 | 3.01 | 3.19 | 3.40 | 2.49 | 2.64 | 2.73 | 107 | 114 | 109 |
| 17 | 3.00 | 3.16 | 3.39 | 2.48 | 2.63 | 2.73 | 106 | 113 | 109 |
| 18 | 3.00 | 3.20 | 3.36 | 2.48 | 2.65 | 2.72 | 107 | 111 | 111 |
| 19 | 3.00 | 3.16 | 3.36 | 2.49 | 2.64 | 2.72 | 107 | 112 | 111 |
| 20 | 2.82 | 2.70 | 3.08 | 2.41 | 2.45 | 2.59 | 106 | 109 | 106 |
| 21 | 3.05 | 3.19 | 3.40 | 2.52 | 2.64 | 2.73 | 102 | 100 | 101 |
| 22 | 3.05 | 3.21 | 3.41 | 2.53 | 2.65 | 2.74 | 102 | 100 | 101 |

| | Temperature Dependency | | | Humidity Dependency | | | |
|---|---|---|---|---|---|---|---|
| Sample No. | Blue-sensitive Layer | Green-sensitive Layer | Red-sensitive Layer | Blue-sensitive Layer | Green-sensitive Layer | Red-sensitive Layer | |
| 12 | 109 | 110 | 109 | 90 | 88 | 98 | Comparison |
| 13 | 110 | 109 | 109 | 90 | 88 | 97 | Invention |
| 14 | 110 | 109 | 109 | 90 | 87 | 98 | Invention |
| 15 | 109 | 110 | 110 | 89 | 88 | 97 | Invention |
| 16 | 109 | 110 | 109 | 89 | 88 | 98 | Invention |
| 17 | 110 | 109 | 110 | 90 | 88 | 98 | Invention |
| 18 | 109 | 109 | 110 | 89 | 87 | 97 | Invention |
| 19 | 109 | 109 | 110 | 90 | 88 | 98 | Invention |
| 20 | 109 | 110 | 110 | 89 | 88 | 98 | Comparison |
| 21 | 109 | 110 | 110 | 89 | 88 | 98 | Invention |
| 22 | 107 | 107 | 108 | 92 | 91 | 100 | Invention |

As apparent from the results in Table 3, addition of a spectral sensitizing dye according to the method of the invention provides a high contrast and a high Dmax value. Further, utilization of a specific metal compound in the manufacturing method of the invention improves the latent image stability in the very early stage, and raising the pAg in the chemical ripening after the addition of the spectral sensitizing dye according to the method of the invention minimizes the sensivity fluctuation attributable to the temperature and humidity at the time of exposure.

As described above, the method for manufacturing a silver halide emulsion according to the invention, in which spectral sensitizing dyes are added after the formation of silver halide grains and chemical ripening is performed at a temperature higher than the addition temperature of the spectral sensitizing dyes, (1) enhanced the linearity of gradation from the medium density part to the shoulder part and thereby could make an emulsion of a high Dmax value, (2) could make a stable emulsion less fluctuating in gradation, and (3) could manufacture a stable emulsion not only excellent in latent image stability in the very early stage of the time interval between exposing and processing, but also less in fluctuation in photographic properties due to the temperature and humiduty at the time of exposure.

What is claimed is:

1. A method for manufacturing a silver halide emulsion comprising, in order, the steps of: forming a silver halide grain desalting, spectral sensitizing by adding a spectral sensitizing dye and chemical maturing, wherein the spectral sensitizing is carried at a temperature not lower than 25° C. and not higher than 55° C.; and the chemical maturing is carried out at a temperature higher than the temperature of the spectral sensitizing.

2. The method of claim 1 wherein the sensitizing dye is represented by formula A, Formula A

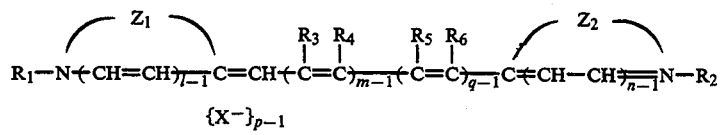

wherein $Z_1$ and $Z_2$, being same or different, each represent a group of atoms necessary to form a heterocycle which may have a substituent; $R_1$ and $R_2$ being same or different and may have a substituent, individually represent an alkyl group, an aryl group, an alkenyl group or an aralkyl group; $R_3$ to $R_6$ each represent a hydrogen atom, an alkyl group having 4 or less carbon atoms, an aryl group, an aralkyl group, or a heterocyclic group; $R_2$ and $R_6$ when q=2, or $R_3$ and $R_5$ when m=2 and q=2, may form a five- or six- membered alkylene bridge; l, m, n, q and p each represent 1 or 2; $X^-$ represents an anion.

3. The method of claim 2 wherein l, m, n and p each represent 1 or 2, and q represents 1.

4. The method of claim 3 wherein l, n and p each represent 1 or 2, and m represents 1, and q represents 1.

5. The method of claim 2 wherein $Z_1$ and $Z_2$ each represent a benzothiazole nucleus, a benzimidazole nucleus or benzothiazole nucleus.

6. The method of claim 2 wherein $R_1$ and $R_2$ each represent an alkyl group having a sulfo group.

7. The method of claim 2 wherein $R_3$ to $R_6$ each represent a hydrogen atom, an alkyl group having not more than 4 carbon atoms, aralkyl group, aryl group or a heterocyclic group represented by formula B:

Formula B

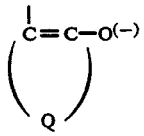

wherein Q represents a group of nonmetallic atoms necessary to form a five- or six-membered heterocyclic nucleus selected from the group consisting of pyrazolone derivatives, isooxazolone derivatives, oxazolone derivatives, 2,4,6-triketohexahydropyrimidine derivatives, 2-thio-2,4,6-triketohexahydropyrimidine derivatives, rhodanine derivatives, 2,4-thiazolidinedione derivatives, 2-thio-2,4-oxazolidinedione derivatives, thianaphthenone derivatives, hydantoin derivatives, indanedione derivatives and oxyindole derivatives.

8. The method of claim 2 wherein an average grain size of the silver halide grains is 0.2 to 1.6 μm.

9. The method of claim 8 wherein the average grain size is 0.25 to 1.2 μm.

10. The method of claim 2 wherein the silver halide grain contains not less than 90 mol % of silver chloride, not more than 10 mol % of silver bromide and not more than 0.5 mol % of silver iodide.

11. The method of claim 10 wherein the emulsion contains not less than 60 weight % of grains having not less than 90 mol % of silver chloride content.

12. The method of claim 11 wherein the emulsion contains not less than 80 weight % of grains having not less than 90 mol % of silver chloride content.

13. A method for manufacturing a silver halide photo-sensitive material comprising, in order, the steps of:

(a) preparing a silver halide emulsion containing a silver halide grain having an average grain size of 0.25 to 1.2 μm, (b) desalting, (c) spectral sensitizing by adding a spectral sensitizing dye, (d) chemical maturing, (e) forming a silver halide photo-sensitive layer on a support, wherein process is carried in this order;

the spectral sensitizing is carried by adding a sensitizing dye represented by formula A, at a temperature 25° C. to 55° C., Formula A

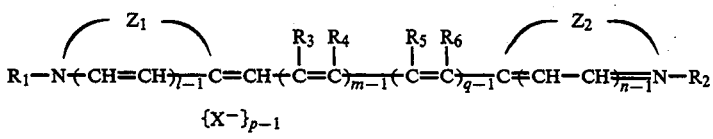

wherein $Z_1$ and $Z_2$, being same or different, each represent a benzothiazole nucleus, a benzimidazole nucleus or benzothiazole nucleus, which may have a substituent;

$R_1$ and $R_2$ each represent an alkyl group having a sulfo group;

$R_3$ to $R_6$ each represent a hydrogen atom, an alkyl group having not more than 4 carbon atoms, aralkyl group, aryl group or a heterocyclic group represented by formula B:

Formula B

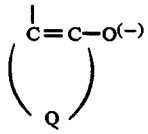

wherein Q represents a group of nonmetallic atoms necessary to form a five- or six-membered heterocyclic nucleus selected from the group consisting of pyrazolone derivatives, isooxazolone derivatives, oxazolone derivatives, 2,4,6-triketohexahydropyrimidine derivatives, 2-thio-2,4,6-triketohexahydropyrimidine derivatives, rhodanine derivatives, 2,4-thiazolidinedione derivatives, 2-thio-2,4-oxazolidinedione derivatives, thianaphthenone derivatives, hydantoin derivatives, indanedione derivatives and oxyindole derivatives;

$R_3$ to $R_6$ each represent a hydrogen atom, an alkyl group having 4 or less carbon atoms, an aryl group, an aralkyl group, or a heterocyclic group; $R_2$ and $R_6$ when q=2, or $R_3$ and $R_5$ when m=2 and q=2, may form a five- or six-membered alkylene bridge; l, m, n, q and p each represent 1 or 2; $X^-$ represents an anion;

the chemical maturing is carried out at a temperature higher than the temperature applied at the spectral sensitizing;

the silver halide grain contains not less than 90 mol % of silver chloride, not more than 10 mol % of silver bromide and not more than 0.5 mol % of silver iodide; and the emulsion contains not less than 60 weight % of grains having not less than 90 mol % of silver chloride content.

14. The method of claim 13 wherein, in preparation of said silver halide emulsion, an iridium compound is added in an amount of not less than $10^{-11}$ mol per mol of silver halide.

15. The method of claim 14 wherein the amount of said iridium compound is not less than $10^{-9}$ mol per mol of silver halide compound.

* * * * *